United States Patent [19]

Tosaka et al.

[11] Patent Number: 4,749,644

[45] Date of Patent: Jun. 7, 1988

[54] PHOTOGRAPHIC MATERIAL WITH TWO SIZE POPULATION OF SILVER HALIDE GRAINS AND DEVELOPMENT INHIBITING AGENT IN AN EMULSION LAYER

[75] Inventors: Yasuo Tosaka; Keiji Ogi; Atsushi Kamitakahara, all of Hino, Japan

[73] Assignee: Konishiroku Photo Industry Co., Ltd., Tokyo, Japan

[21] Appl. No.: 875,611

[22] Filed: Jun. 18, 1986

[30] Foreign Application Priority Data

Jun. 28, 1985 [JP] Japan ..... 60-143069

[51] Int. Cl.[4] ..... G03C 7/32; G03C 1/02; G03C 1/08; G03C 7/26

[52] U.S. Cl. ..... 430/544; 430/505; 430/547; 430/552; 430/553; 430/554; 430/555; 430/556; 430/557; 430/558; 430/567; 430/598; 430/940; 430/957

[58] Field of Search ..... 430/505, 547, 549, 598, 430/567, 556, 557, 552, 553, 554, 555, 558, 957, 940

[56] References Cited

U.S. PATENT DOCUMENTS

| | | | |
|---|---|---|---|
| 3,600,180 | 8/1971 | Judd et al. | 430/940 |
| 3,761,276 | 9/1973 | Evans | 430/406 X |
| 4,431,728 | 2/1984 | Abe et al. | 430/544 |
| 4,433,050 | 2/1984 | Abe et al. | 430/940 X |
| 4,440,851 | 4/1984 | Tosaka et al. | 430/940 X |
| 4,444,865 | 4/1984 | Silverman et al. | 430/940 X |
| 4,444,874 | 4/1984 | Silverman et al. | 430/509 X |
| 4,643,965 | 2/1987 | Kubota et al. | 430/940 X |

*Primary Examiner*—Mukund J. Shah

*Attorney, Agent, or Firm*—Frishauf, Holtz, Goodman & Woodward

[57] ABSTRACT

In a light-sensitive direct posi silver halide color photographic material having photographic constituent layers comprising at least one silver halide emulsion layer containing latent image type silver halide grains not previously fogged, which is capable of giving a direct posi image by subjecting the whole surface to exposure or effecting surface development in the presence of a fogging agent, after image exposure, the improvement wherein said internal latent image type silver halide grains are composed of at least two groups of internal latent image type silver halide grains having average grain sizes different from each other, and at least one compound capable of releasing a development inhibiting substance or its precursor through the reaction with the oxidized product of a color developing agent is contained in at least one layer of said photographic constituent layers.

According to the present invention, there can be obtained a direct posi color photographic material improved in processing stability, having smooth gradation and excellent image quality, in which the respective photographic performances of at least two groups of internal latent type silver halide grains having grains sizes different from each other are fully utilized.

15 Claims, No Drawings

PHOTOGRAPHIC MATERIAL WITH TWO SIZE POPULATION OF SILVER HALIDE GRAINS AND DEVELOPMENT INHIBITING AGENT IN AN EMULSION LAYER

BACKGROUND OF THE INVENTION

This invention relates to a light-sensitive direct posi silver halide photographic material, more particularly to a light-sensitive color photographic material having an internal latent image type silver halide emulsion layer capable of giving a direct posi image by subjecting the whole surface to exposure or carrying out surface development in the presence of a fogging agent, after image exposure.

Methods for obtaining direct posi images known in the prior art can be classified mainly into two types. In one of them, a silver halide emulsion having previously fogged nucleus is employed and posi image is obtained after development by destroying the fogged nucleus or the latent image at the exposed portion by utilizing solarization or Hershel effect, etc. In the other type, an internal latent image type silver halide emulsion not previously subjected to fogging is employed, and fogging treatment (treatment for forming developing nucleus) is applied after image exposure and then surface development is performed, or alternatively surface treatment is performed while applying fogging treatment (treatment for forming developing nucleus) after image exposure, whereby a posi image can be obtained.

The above fogging treatment (treatment for forming developing nucleus) may be conducted by way of giving the whole surface exposure, chemically by use of a fogging agent, or by use of a strong developing solution, or further by heat treatment, etc.

Of the above two methods for formation of posi images, the methods of the latter type are generally higher in sensitivity than the methods of the former type and therefore suitable for uses in which high sensitivity is required.

In this field of the art, various techniques have been hitherto known. For example, there have been known the methods disclosed in U.S. Pat. Nos. 2,592,250, 2,497,875, 2,588,982, 3,761,266, 3,761,276, 3,796,577 and U.K. Pat. No. 1,151,363.

Although a light-sensitive photographic material for forming a posi image can be prepared by use of these known techniques, it has been desired to further improve photographic performance and solve the problems in manufacture in order for these light-sensitive photographic materials to be applied for various kinds of photographic fields.

In this field of the art, it has been widely known to produce a light-sensitive direct posi photographic material by use of two or more kinds of internal latent image type emulsions. For example, U.S. Pat. No. 4,035,185 discloses mixing of the core/shell type emulsions in which the extent of internal chemical sensitization is varied, but the emulsion which has been internally chemically sensitized to deeper extent is not sufficient in the effect of posi image formation. Thus, even a mixed emulsion is desired to attain still higher maximum density.

Japanese Unexamined Patent Publications Nos. 111938/1983 and 77436/1984 disclose mixing and overlaying of the core/shell type emulsion and the fine particulate emulsion. However, the fine particulate emulsion alone cannot form an image, but it is merely provided for improvement of coating power. Therefore, photographic performances possessed by the respective emulsions cannot be fully utilized, and the minimum density is also high.

Also, in the silver halide emulsion layer having substantially the same light-sensitive wavelength region, by mixing internal latent type silver halide emulsions with different grains or coating of such emulsions in separate layers, a broad exposure latitude can be obtained or gradation can be controlled. However, since grains with different grain sizes are different in progress of development, gradation of so called poor continuation differing greatly between gradation at the leg portion and gradation at the shoulder portion may be obtained, and the results may not be necessarily satisfactory with respect to stability when the development processing conditions are varied.

It has also been desired in the prior art to improve image quality of the light-sensitive silver halide color photographic material (hereinafter called color photographic material), above all sharpness. Particularly, in the case of a direct posi color photographic material, it has been found that sharpness is further deteriorated. Although the cause has not yet been clarified, it may be speculated as follows. That is, after image exposure of the direct posi color photographic material, developed nucleus is formed on the silver halide surface by subjecting the whole surface to exposure or carrying out surface development in the presence of a fogging agent. Accordingly, after the developed nucleus is formed, an abrupt developing reaction occurs, causing the oxidized product of the color developing agent to accumulated at high concentration and deteriorate image quality of the color developed dye image. Also, image quality deterioration, which becomes more marked as the development processing time is shortened, is an obstacle against rapid processing.

Such image quality deterioration cannot be reduced to give fully satisfactory good image quality by optical means such as inclusion of a water-soluble dye in a color photographic material.

Accordingly, the object of the present invention is to provide a direct posi color photographic material with improved processing stability, having smooth gradation and excellent image quality, in which the respective photographic performances of the internal latent type silver halide grains with different grains sizes are fully utilized.

SUMMARY OF THE INVENTION

The direct posi color photographic material of the present invention which solves the above technical task is a light-sensitive direct posi silver halide color photographic material having: (A) photographic constituent layers comprising at least one silver halide emulsion layer containing latent image type silver halide grains not previously fogged, which is capable of giving a direct posi image by subjecting the whole surface to exposure or effecting surface development in the presence of a fogging agent after image exposure, wherein said internal latent image type silver halide grains are composed of at least two groups of internal latent image type silver halide grains having average grain sizes different from each other, and (B) at least one compound capable of releasing a development inhibiting substance or its precursor through the reaction with the oxidized product of a color developing agent (hereinafter called DIR compound) contained in at least one layer of said photographic constituent layers.

The photographic constituent layer as herein mentioned refers to all the hydrophilic colloid layers participating in image formation, as exemplified by silver silver halide emulsion layer, subbing layer, intermediate layer (mere intermediate layer, filter layer, UV-ray absorbing layer, anti-halation layer, etc.), protective layer, etc.

DETAILED DESCRIPTION OF THE PREFERRED EMBODIMENTS

The internal latent image type silver halide of the present invention can be selected suitably depending on the photographic characteristics or effects, etc., demanded for photographic materials. As the internal latent image type silver halide, reference can be made to, for example, Research Disclosure (hereinafter abbreviated as RD) No. 15162. The internal latent image type silver halide grains to be used in the present invention can be selected from any of the compositions of silver bromide, silver iodobromide, silver chlorobromide, silver chloroiodobromide, silver chloroiodide, silver chloride. Preferably, 80 mol% or less of silver chloride and 15 mol% or less of silver iodide are contained based on the total silver halide of said grains.

As the internal latent image type silver halide grains of the present invention, there may be employed those obtained by chemical sensitization of the cores or the core/shell type emulsion in which a doping agent is absorbed internally in the grains, as described in Japanese Patent Publication No. 34213/1977.

The internal latent image type silver halide grains of the present invention may employ the conversion type emulsion as disclosed in U.S. Pat. No. 2,592,250. It is also possible to use the core/shell type emulsion having the conversion type emulsion as the core as disclosed in Japanese Unexamined Patent Publication No. 127549/1980.

The internal latent image type silver halide grains of the present invention can use the laminated type silver halide emulsion as disclosed in Japanese Patent Publication No. 1412/1983.

In case where the silver halide grains of the present invention are composed of two groups of internal latent image type silver halide grains having average grain sizes different from each other, "two groups of internal latent image type silver halide grains having average grain sizes different from each other" refer to the case in which the average grain size of one group of said two groups of internal latent image type silver halide grains is 90% or less based on the average grain size of the other group of said two groups.

The method for measurement of average grain size of silver halide grains is described in detail in, for example, "The Theory of Photographic Process", written by James, fourth edition, p. 100.

At least two groups of the internal latent image type silver halide grains having average grain sizes different from each other to be used in the present invention may be also a poly-dispersed emulsion in which individual grains are distributed in a wide range of grain sizes, but preferably a mono-dispersed emulsion with narrow grain size distribution. Here, "mono-dispersed emulsion" means one in which 60 wt.% or more of individual silver halide grains should have sizes which are not different from the average grain size by 20% or more. The average grain size is preferably 0.2 to 1.4 μm, more preferably 0.3 to 1.2 μm.

As the method for preparation of the above mono-dispersed emulsion, there may be employed typically the double jet method as disclosed in Japanese Patent Publication No. 36870/1973 and Japanese Unexamined Patent Publications Nos. 48520/1979 and 65521/1979, and also the premix method disclosed in Japanese Unexamined Patent Publication No. 158220/1979.

At least two kinds of internal latent image type silver halide grains having different average grain sizes in the present invention can be mixed and coated as the same silver halide emulsion layer on a support, or alternatively they can be overlaid as separate silver halide emulsion layers. When they are overlaid, the order of coating may be such that either one of them may be nearer to the support. Also, in the case of overlaying, they can be coated adjacent to each other, or alternatively overlaid by coating through an intermediary layer such as an intermediate layer, etc.

In using at least two groups of different silver halide grains in the present invention, the mixing ratio during usage thereof can be optimally determined by selecting the silver halide composition, mean grain sizes, average grain ratio, sensitizing conditions, etc., between the different kinds of grains so that they may be in conformity with the photographic characteristic demanded and the characteristic curve may be smooth. The mixing ratio is 5:95 to 95 to 95 to 5, and the optimum mixing ratio can be within the range from 10:90 to 90:10. In the case of overlaying, the above numerical values may be read as the amount of silver halide attached.

The internal latent image type silver halide grains of the present invention should preferably be not chemically sensitized on the grain surfaces or sensitized, if any, to very slight extent.

By "not previously fogged on the grain surfaces" is meant that the density obtained when a test strip, which is coated with the emulsion used in the present invention so as to give 35 mgAg/cm$^2$ on a transparent film support, is developed without exposure with the surface developing solution A shown below at 20° C. for 10 minutes does not exceed 0.6, preferably 0.4.

| Surface developing solution A | |
|---|---|
| Metol | 2.5 g |
| l-ascorbic acid | 10 g |
| $NaBO_2.4H_2O$ | 35 g |
| KBr | 1 g |
| Water | added to one liter. |

Also, the silver halide emulsion according to the present invention gives sufficient density when the test strip as prepared above is developed after exposure with an inner developing solution B having the following recipe.

| Inner developing solution B | |
|---|---|
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water | added to one liter. |

To describe in more detail, when a part of the above test strip is exposed to a light intensity scale over a predetermined time up to about one second and developed with the inner developing solution B at 20° C. for 4 minutes, there is exhibited the maximum density which is at least 5-fold, preferably at least 10-fold of that obtained when another part of said test strip exposed under the same conditions is developed with the surface developing solution A at 20° C. for 4 minutes.

As representative DIR compounds according to the present invention, there are DIR couplers in which a group capable of forming a compound having a development inhibiting action when eliminated from the active site is introduced at the active site of the coupler, as disclosed in U.K. Pat. No. 935,454, U.S. Pat. Nos. 4,095,984 and 4,149,886, and Japanese Unexamined Patent Publication No. 151944/1982. When the above DIR coupler undergoes the coupling reaction with the oxidized product of a color developing agent, the coupler mother nucleus forms a dye, while on the other hand releasing a development inhibitor. The present invention also includes compounds which release development inhibitors but not form dyes upon coupling reaction with the oxidized product of a color developing agent, as disclosed in U.S. Pat. Nos. 3,928,041, 3,958,993, 3,961,959, 4,052,213, Japanese Unexamined Patent Publication Nos. 110529/1978, 13333/1979 and 161237/1980. Further, the present invention includes the so called timing DIR compounds which are compounds in which the mother nucleus forms a dye or a colorless compound, while the timing group eliminated releases a development inhibitor through the intramolecular nucleophilic substitution reaction or elimination reaction, when reacting with the oxidized product of a color developing agent, as disclosed in Japanese Unexamined Patent Publications Nos. 145135/1979, 114946/1981 and 154234/1982.

Also, there are included timing DIR compounds in which the timing group as described above is bonded to the coupler mother nucleus which forms a completely diffusible dye when reacting with the oxidized product of a color developing agent, as disclosed in Japanese Unexamined Patent Publications Nos. 160954/1983 and 162949/1983.

According to the present invention, more preferable DIR compounds can be represented by Formulae (I) and (II) shown below and, among them, the most preferable DIR compounds are those represented by Formula (II) shown below.

Coup-inhibitor Formula (I)

In Formula, (I), Coup is a coupler component (compound) which can undergo coupling with the oxidized product of a color developing agent, as exemplified by open-chain ketomethylene compounds such as acylacetoanilides, acylacetic acid esters, etc.; dye forming couplers such as pyrazolones, pyrazolotriazoles, pyrazolinobenzimidazoles, indazolones, phenols, naphthols, etc.; and coupling components which do not substantially form dyes such as acetophenones, indanones, oxazolones, etc.

The inhibitor in the above formula which is a component (compound) which is eliminated by the reaction with a color developing agent and inhibits development of silver halide. Preferable compounds may include heterocyclic compounds such as benztriazole, 3-octylthio-1,2,4-triazole, etc., and heterocyclic mercapto compounds.

As the above heterocyclic group, there may be included tetrazolyl, thiadiazolyl, oxadiazolyl, thiazolyl, oxazolyl, imidazolyl, triazolyl groups, etc. More specifically, there are 1-phenyltetrazolyl, 1-ethyltetrazolyl, 1-(4-hydroxyphenyl)tetrazolyl, 1,3,4-thiazolyl, 5-methyl-1,3,4-oxadiazolyl, benzthiazolyl, benzoxazolyl, benzimidazolyl, 4H-1,2,4-triazolyl groups and so on.

In the above Formula (I), the inhibitor is bonded to the active site of Coup.

Coup-TIME-inhibitor Formula (II)

In Formula (II), the inhibitor is the same as defined in the above Formula (I). Coup is also inclusive of the coupler component which forms completely diffusible dye similarly as that defined in Formula (I). Time is represented by Formulae (III), (IV), (V) and (VI), but is not limited only to these.

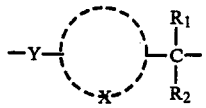

Formula (III)

In formula (III), X represents a group of atoms necessary for completion of a benzene ring or a naphthalene ring. Y represents —O—, —S—,

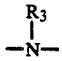

(wherein $R_3$ represents a hydrogen atom, an alkyl or aryl group), and is bonded to the coupling site. Each of $R_1$ and $R_2$ represents the same group as the above $R_3$ and the group

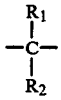

is substituted at the ortho-position or para-position relative to Y and is bonded to the hetero atom contained in the inhibitor.

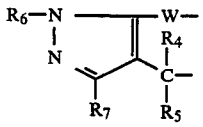

Formula (IV)

In Formula (IV), W is the same group as Y in the above Formula (III), and $R_4$ and $R_5$ are the same groups as $R_1$ and $R_2$ in Formula (III), respectively. $R_6$ is a hydrogen atom, an alkyl, aryl, acyl, sulfone, alkoxycarbonyl group or a heterocyclic residue, and $R_7$ represents a hydrogen atom, an alkyl, aryl group, heterocyclic residue, an alkoxy, amino, acylamide, sulfoneamide, carboxy, alkoxycarbonyl, carbamoyl, or cyano group. And the timing group is bonded through W to the coupling site of Coup and is bonded through

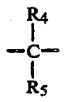

to the hetero atom of the inhibitor.

Next, an example of the timing group which releases an inhibitor through intramolecular nucleophilic substitution reaction is shown by Formula (V).

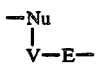

Formula (V)

In Formula (V), Nu is a nucleophilic group having a oxygen, sulfur or nitrogen atom enriched in electrons and is bonded to the coupling site of Coup. E is an electrophilic group having a carbonyl group, a thiocarbonyl group, a phosfinyl group or a thiophosfinyl group deficient in electrons and is bonded to the hetero atom of the inhibitor. V is a bonding group which correlates sterically Nu and E with each other and is subject to intramolecular nucleophilic substitution reaction accompanied with formation of a 3-membered ring or 7-membered ring after release of Nu from Coup, and thereby can release the inhibitor.

$-OCH_2-$ Formula (IV)

In the following, typical specific examples of the DIR compounds according to the present invention are shown, by which the present invention is not limited.

[Exemplary compounds]

(D-1)

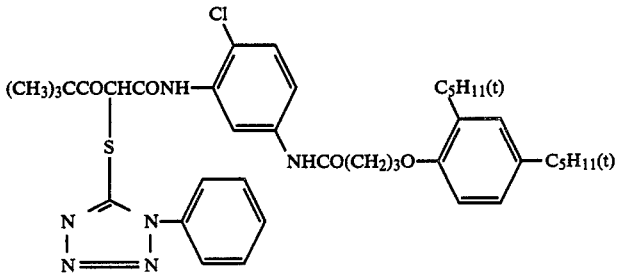

(D-2)

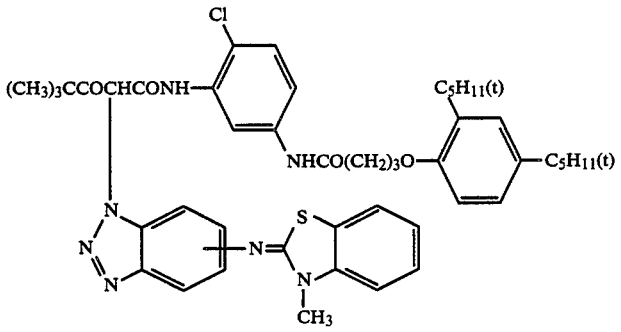

(D-3)

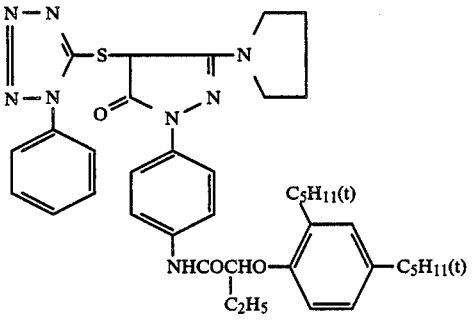

(D-4)

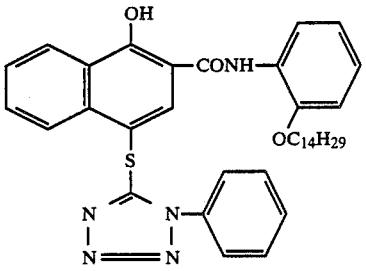

-continued
[Exemplary compounds]
(D-5)
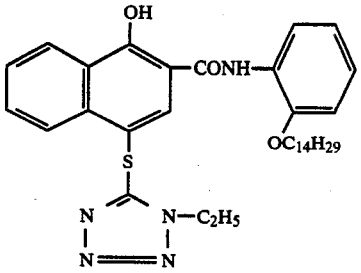
(D-6)
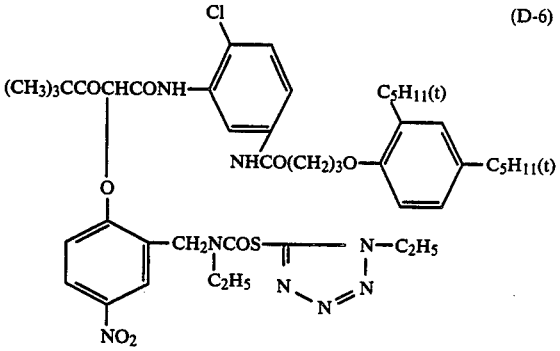
(D-7)
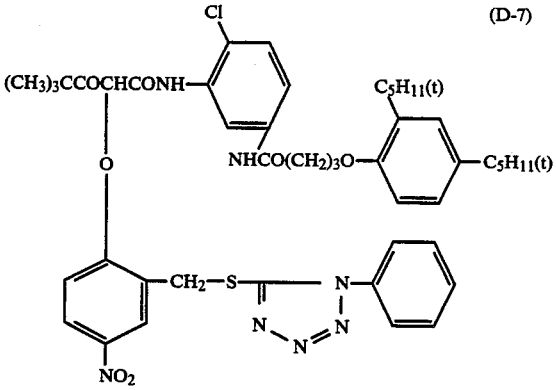
(D-8)
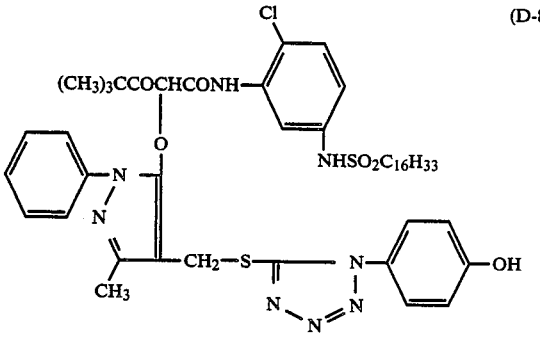
(D-9)
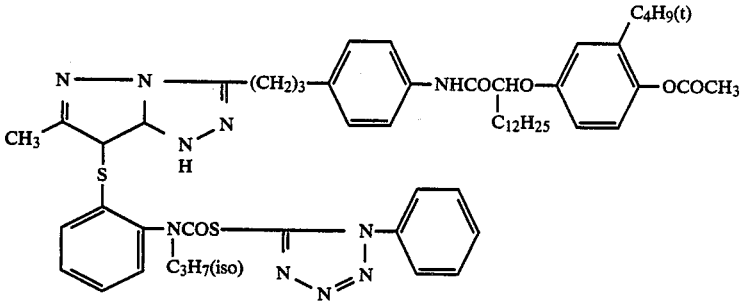
(D-10)
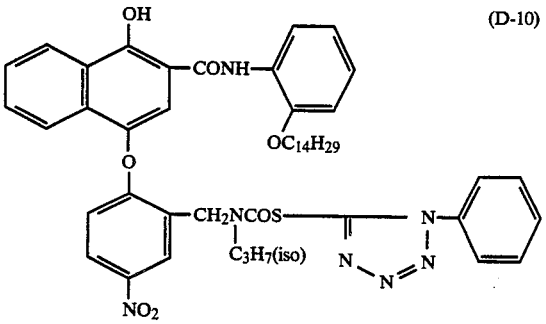
(D-11)
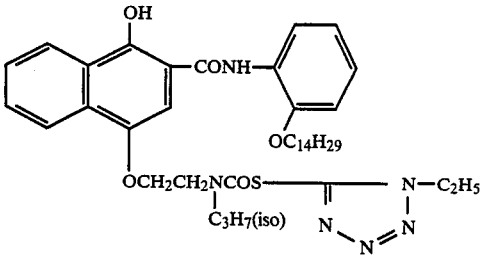

-continued
[Exemplary compounds]
(D-12)
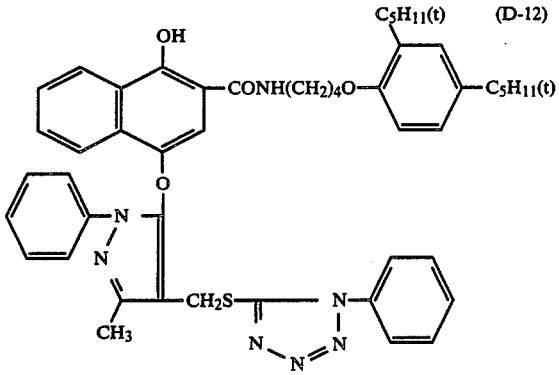
(D-13)
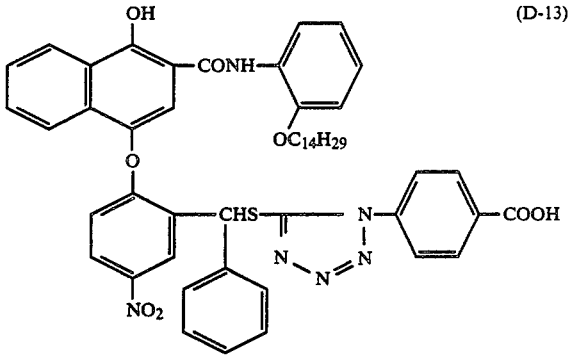
(D-14)
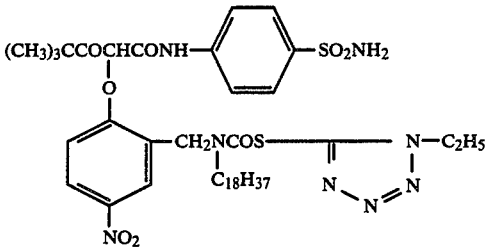
(D-15)
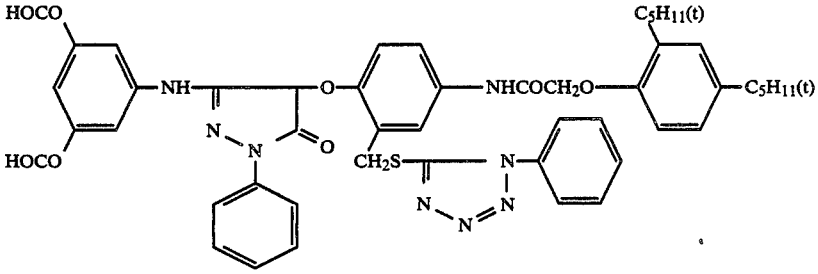
(D-16)
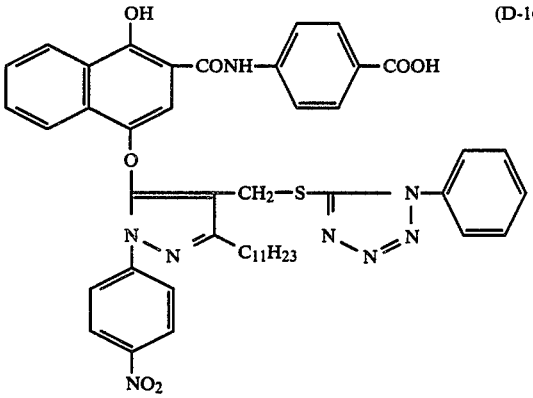
(D-17)
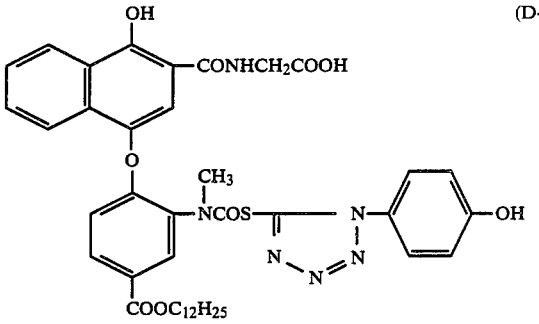
(D-18)
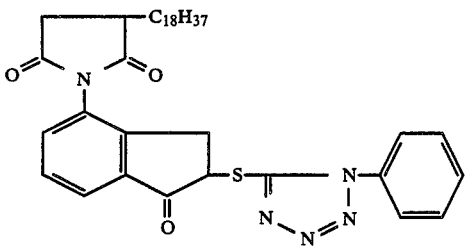
(D-19)
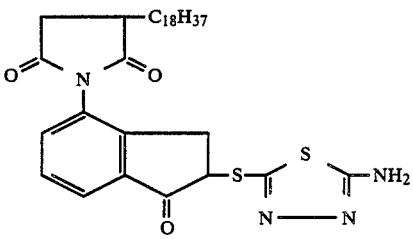

-continued
[Exemplary compounds]
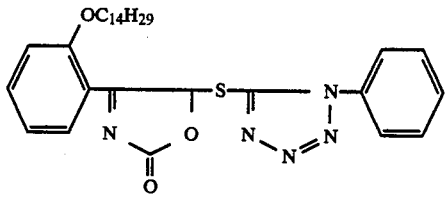
(D-20)
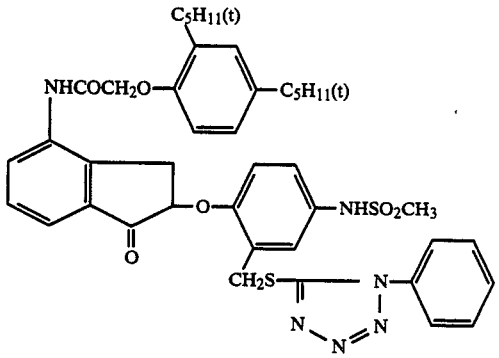
(D-21)
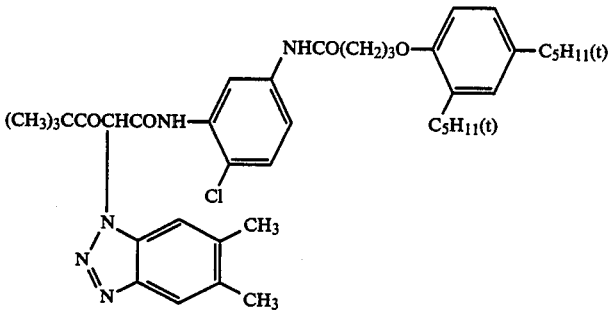
(D-22)
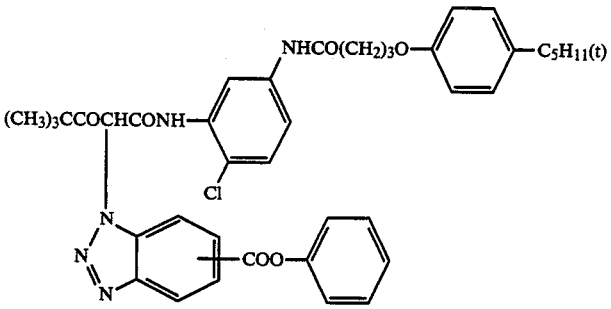
(D-23)
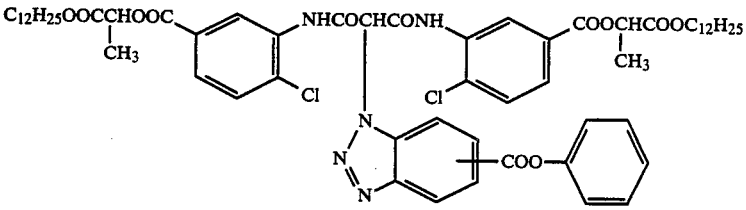
(D-24)
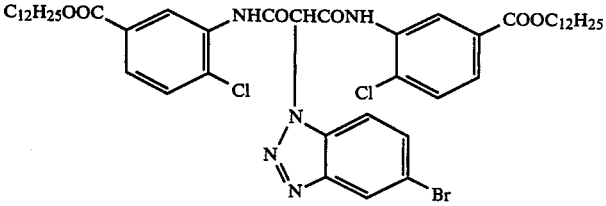
(D-25)

-continued
[Exemplary compounds]
(D-26)
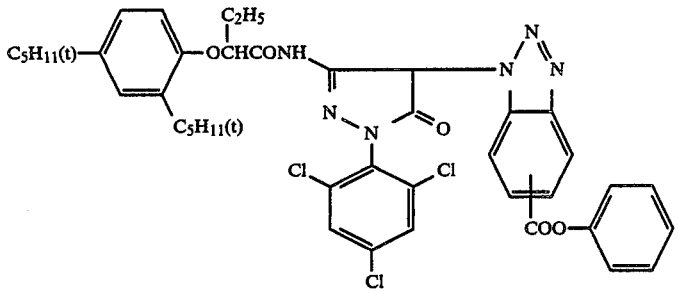
(D-27)
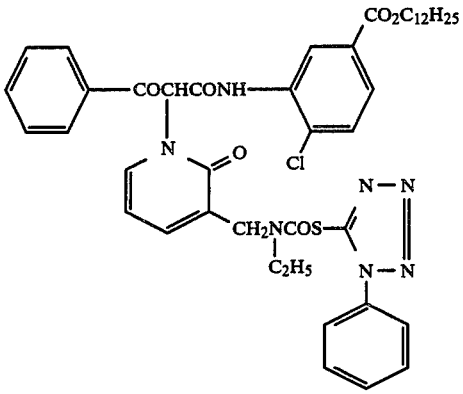
(D-28)
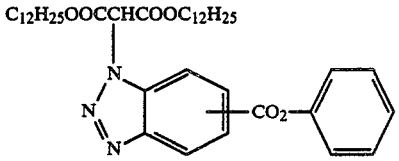
(D-29)
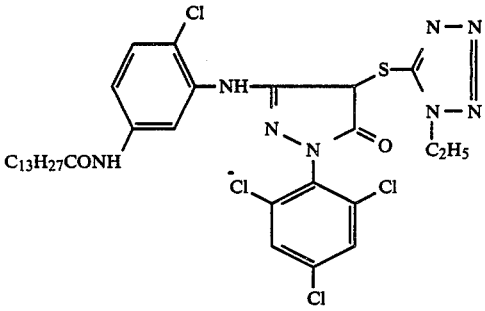
(D-30)
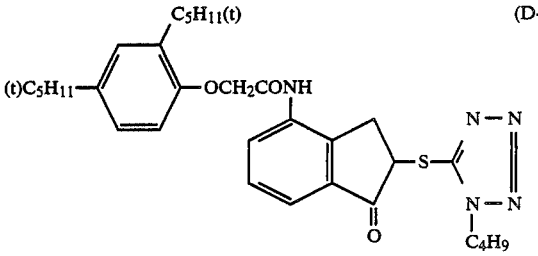
(D-31)
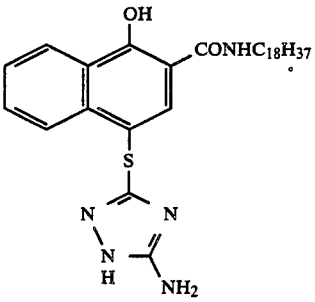
(D-32)
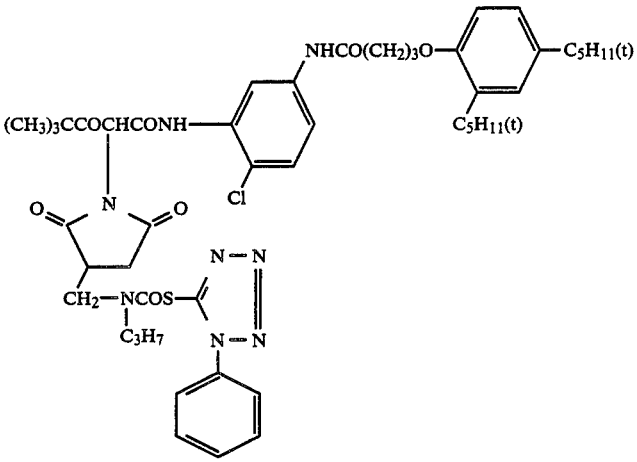

-continued
[Exemplary compounds]
(D-33)
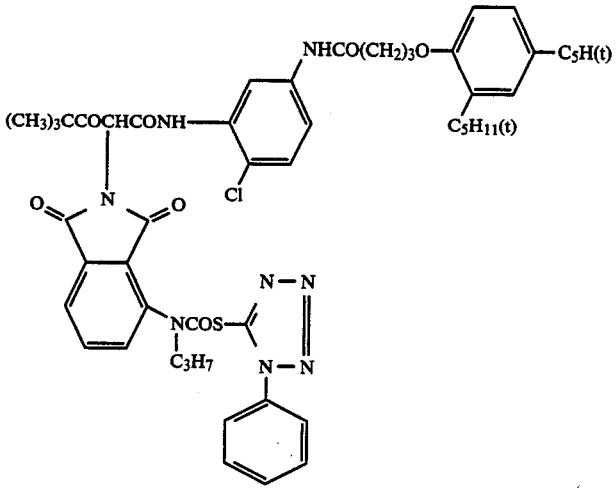
(D-34)
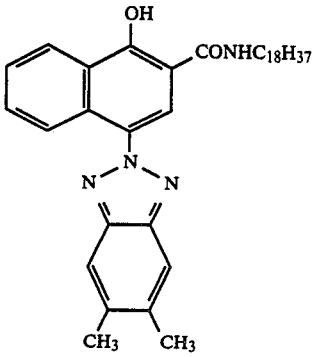
(D-35)
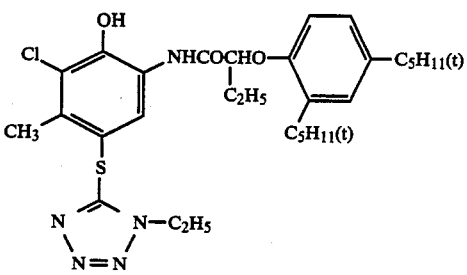
(D-36)
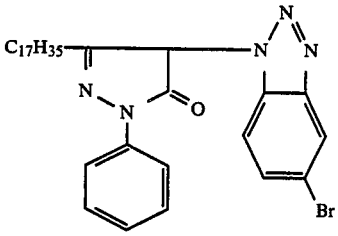
(D-37)
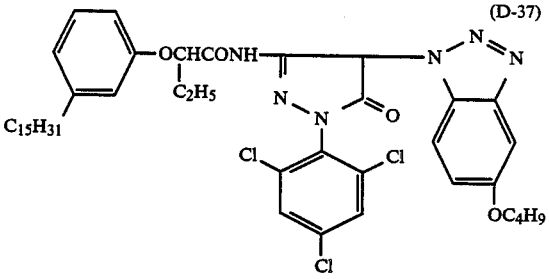
(D-38)
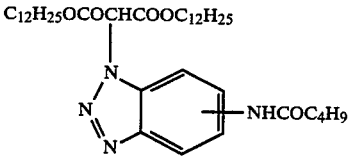
(D-39)
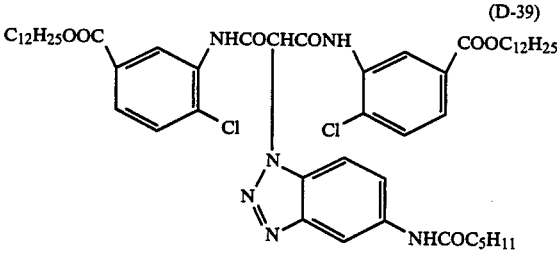
(D-40)
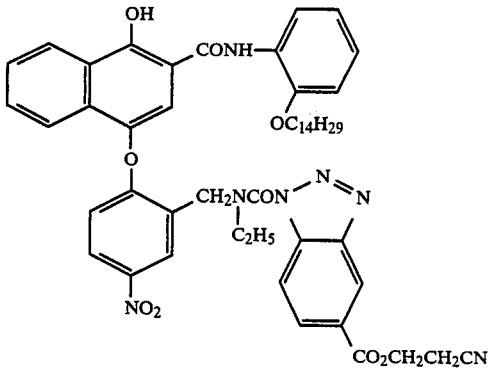

-continued
[Exemplary compounds]
(D-41)
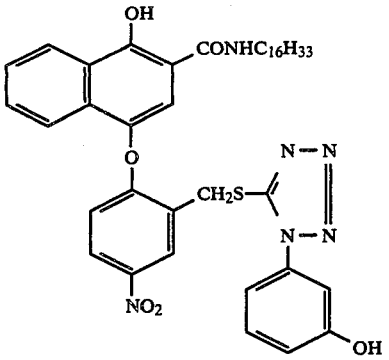
(D-42)
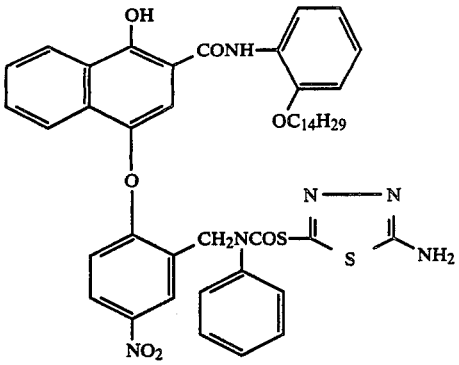
(D-43)
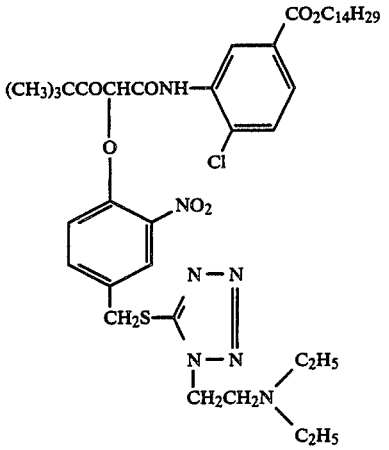
(D-44)
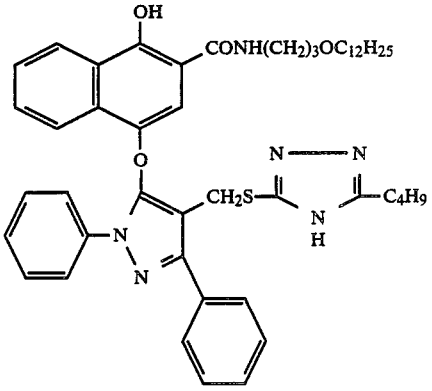
(D-45)
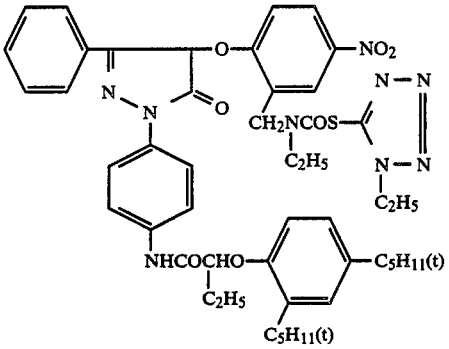
(D-46)
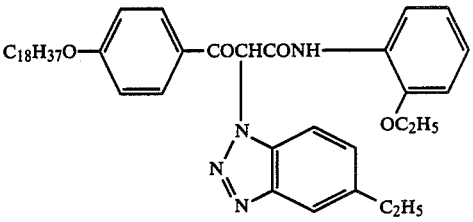
(D-47)
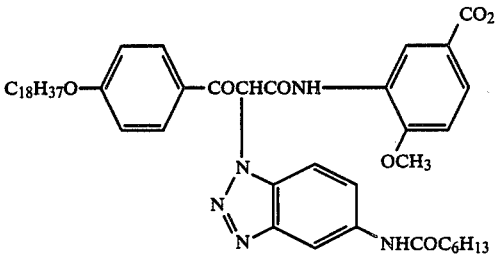
(D-48)
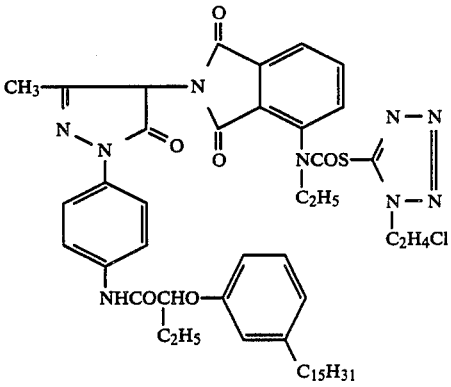

-continued
[Exemplary compounds]
(D-49)
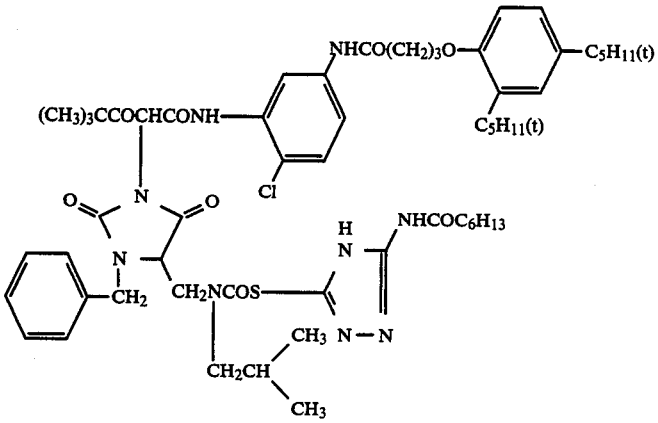
(D-50)
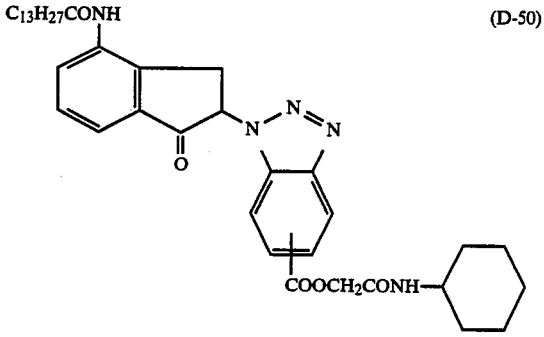
(D-51)
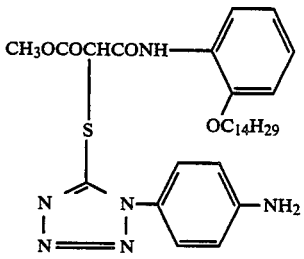
(D-52)
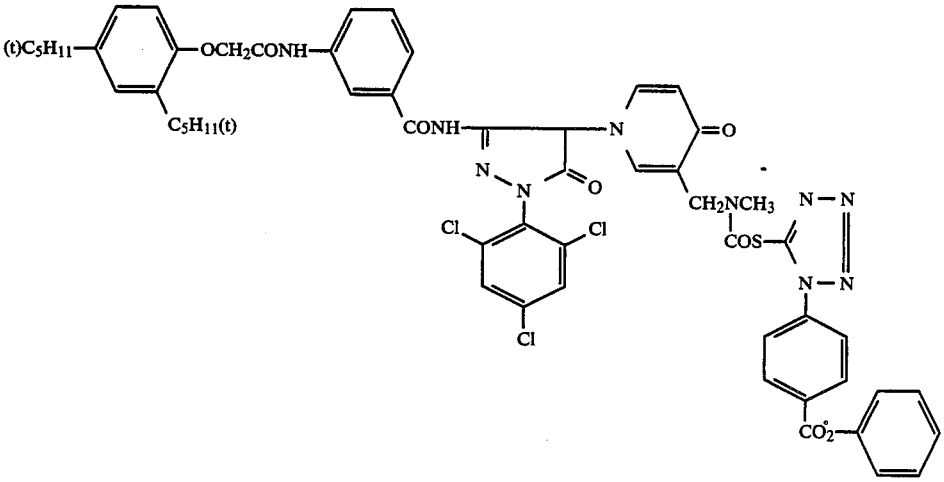
(D-53)
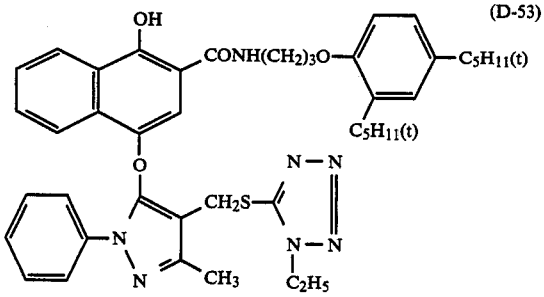
(D-54)
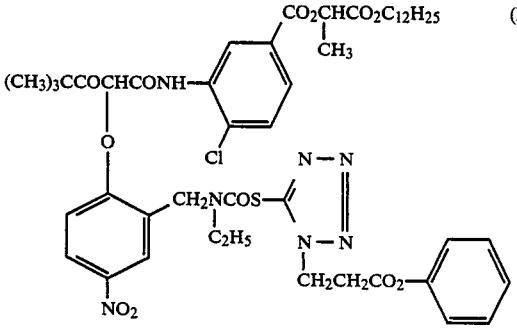

-continued
[Exemplary compounds]
(D-55)
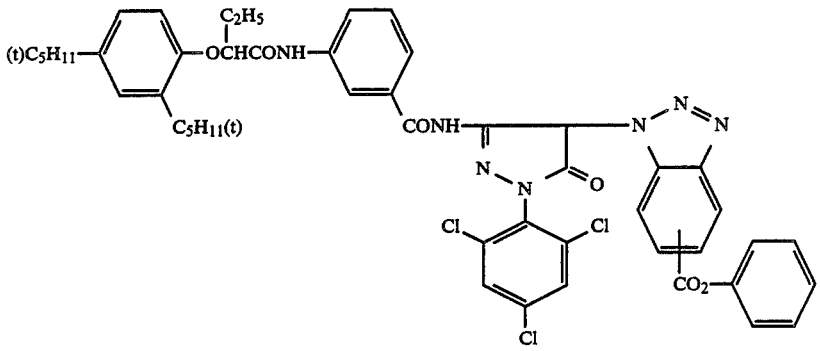
(D-56)
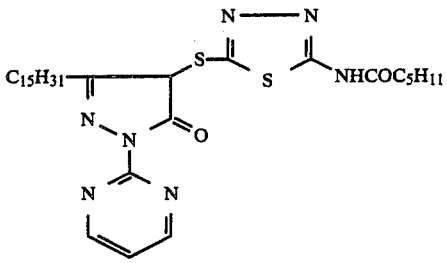
(D-57)
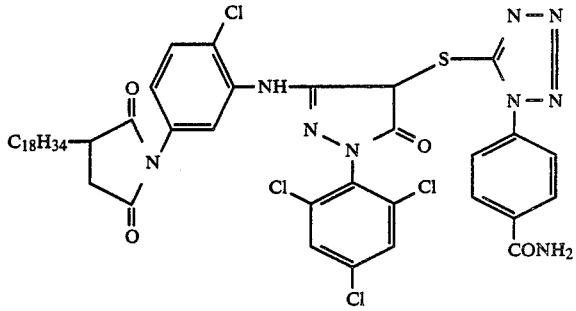
(D-58)
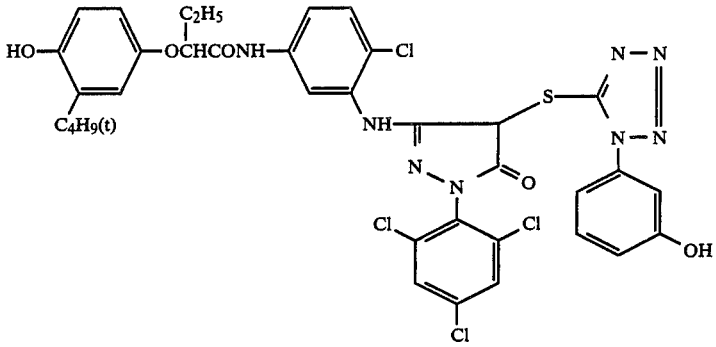
(D-59)
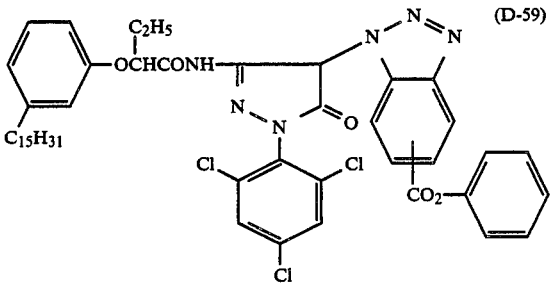
(D-60)
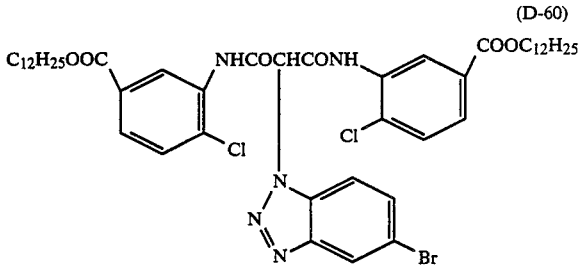

-continued
[Exemplary compounds]
(D-61)
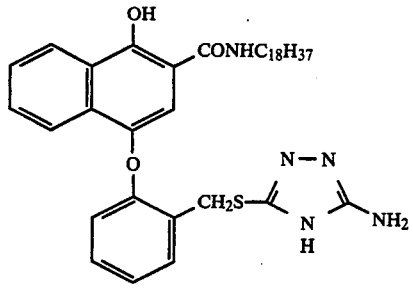
(D-62)
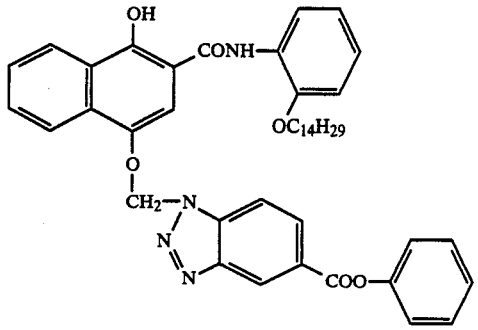
(D-63)
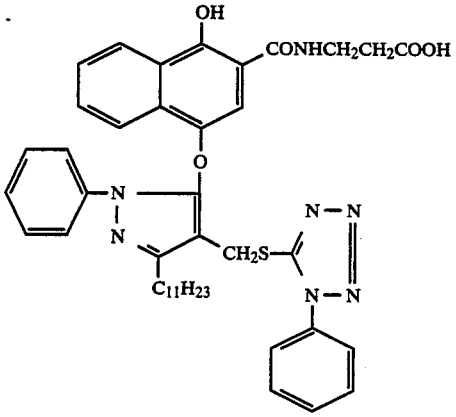
(D-64)
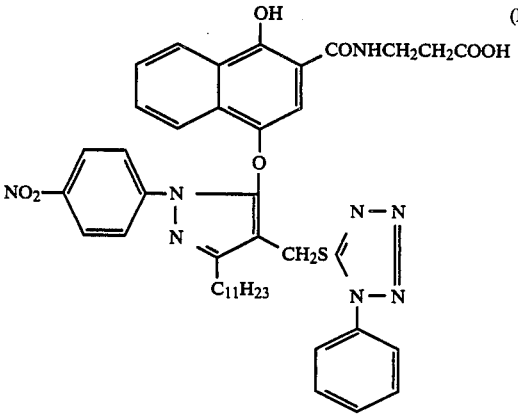
(D-65)
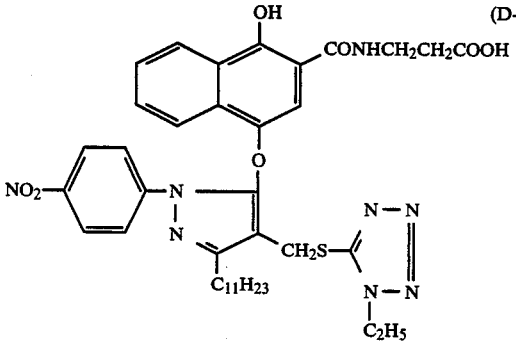
(D-66)
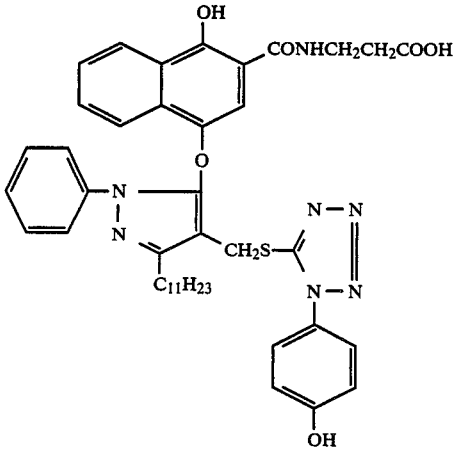
(D-67)
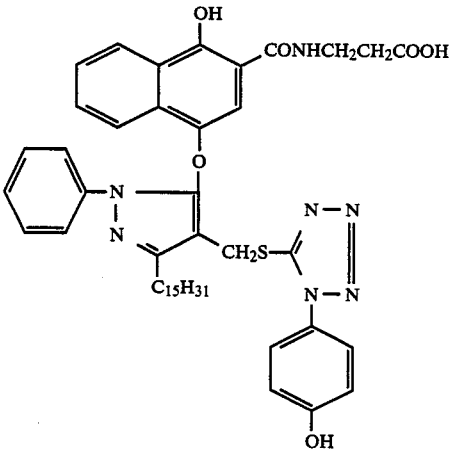
(D-68)
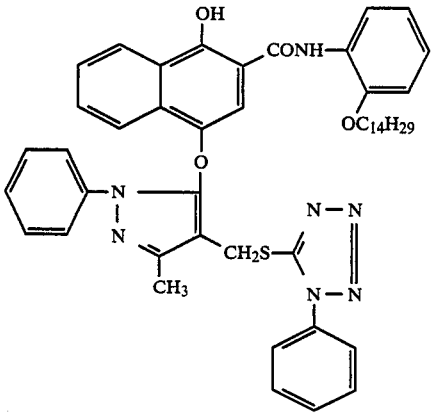

-continued
[Exemplary compounds]
(D-69)
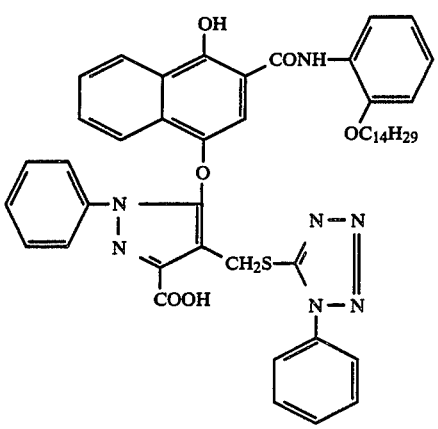
(D-70)
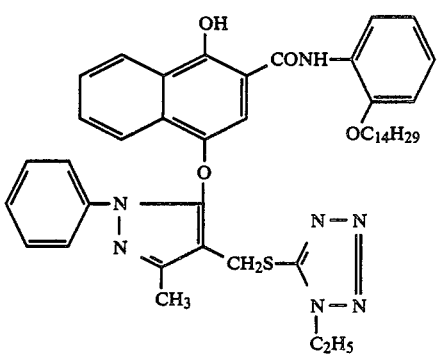
(D-71)
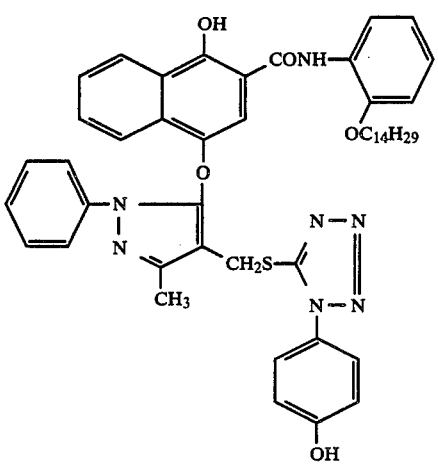
(D-72)
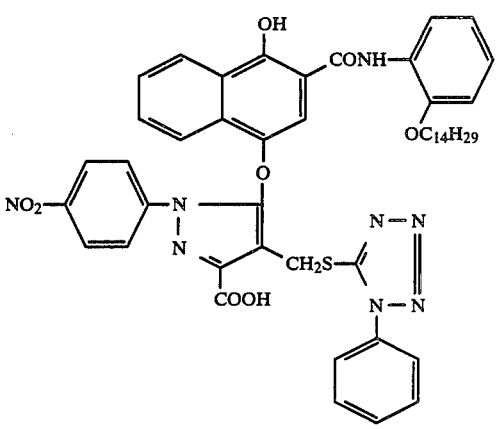
(D-73)
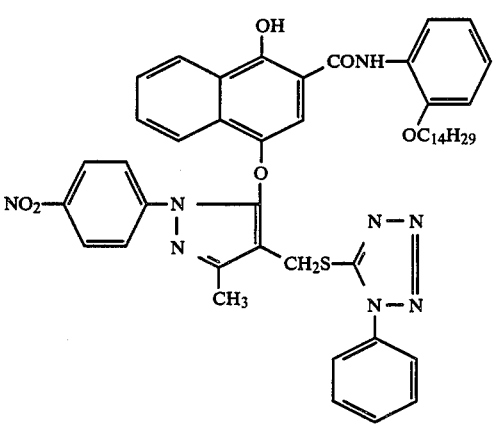
(D-74)
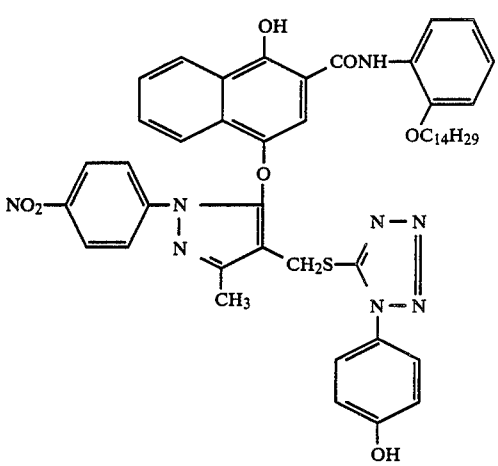

-continued
[Exemplary compounds]
(D-75)
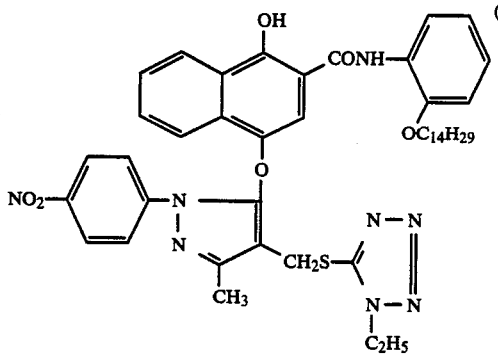
(D-76)
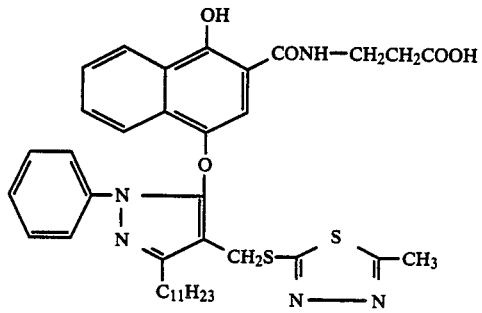
(D-77)
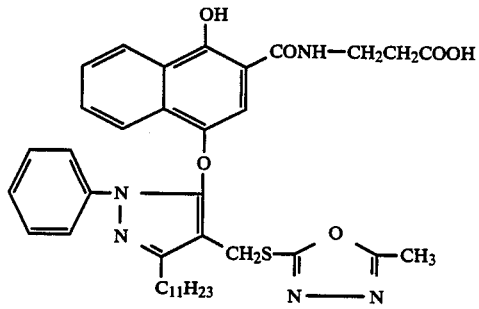
(D-78)
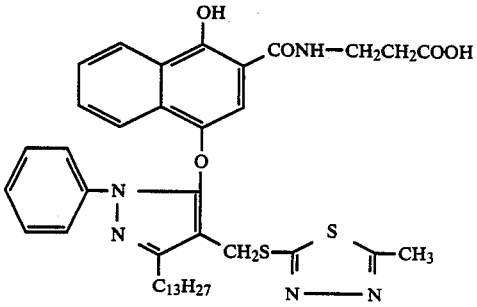
(D-79)
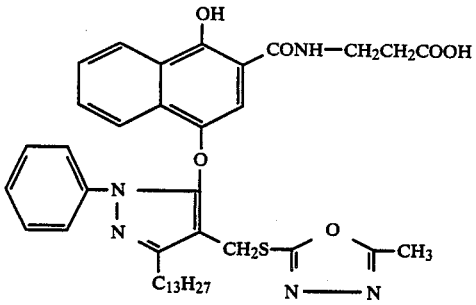
(D-80)
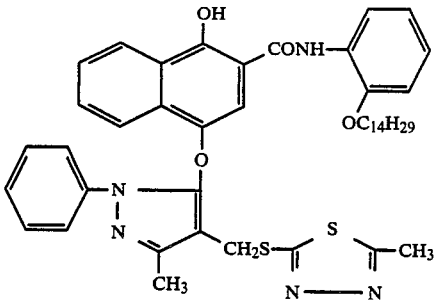
(D-81)
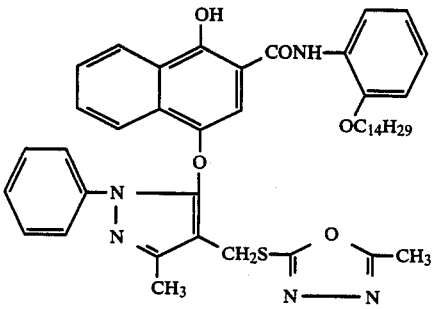
(D-82)
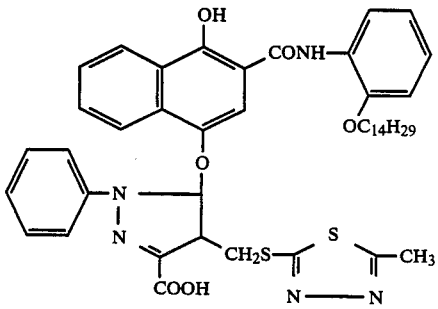

-continued

[Exemplary compounds]

(D-83)

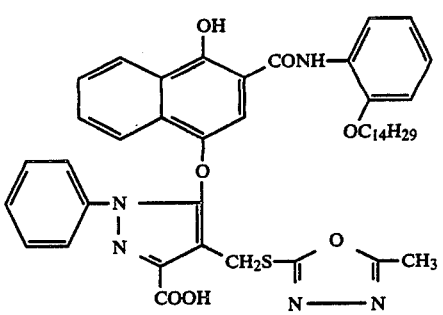

(D-84)

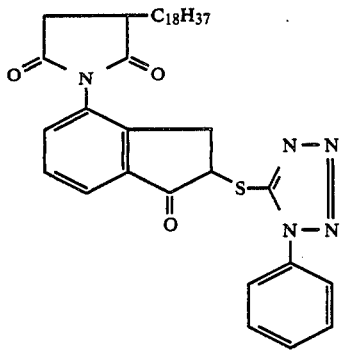

The DIR compound of the present invention can be added in the light-sensitive silver halide emulsion layer and/or non-light-sensitive photographic constituent layer, but it should preferably be added in the light-sensitive silver halide emulsion layer.

Two or more kinds of DIR compounds of the present invention can be contained in the same layer. Alternatively, the same DIR compound may also be contained in two or more different layers.

Generally, these DIR compounds should preferably be used in an amount of $2\times10^{-4}$ to $5\times10^{-1}$ mol per 1 mol of silver in the emulsion layer, more preferably from $1\times10^{-3}$ to $1\times10^{-1}$ mol.

For incorporating the DIR compounds in the silver halide emulsion or coating solution of other photographic constituent layer according to the present invention, when said DIR compounds are alkali-soluble, they may be added as alkaline solutions; when they are oil-soluble, they can preferably be dissolved in a high boiling solvent, optionally together with a low boiling solvent, according to the methods as disclosed in U.S. Pat. Nos. 2,322,027, 2,801,170, 2,801,171, 2,272,191 and 2,304,940 to be dispersed in fine particles before addition into the silver halide emulsion. If desired, a hydroquinone derivative, a UV-ray absorber, a color fading preventive, etc., may also be used in combination. Also, two or more kinds of DIR compounds may be used as a mixture.

In a further preferred method for addition of DIR compounds, one or two or more kinds of said DIR compounds, optionally together with other couplers, a hydroquinone derivative, a color fading preventive, a UV-ray absorber, etc., are dissolved in a high boiling solvent such as organic acid amides, carbamates, esters, ketones, urea derivatives, ethers, hydrocarbons, specifically di-n-butyl phthalate, tricresyl phosphate, triphenyl phosphate, di-isooctyl azelate, di-n-butyl sebacate, tri-n-hexyl phosphate, N,N-diethylcaprylamidobutyl, N,N-diethyllaurylamide, n-pentadecyl phenyl ether, dioctyl phthalate, n-nonylphenol, 3-pentadecylphenyl ethyl ether, 2,5-disec-amylphenyl butyl ether, monophenyl-di-o-chlorophenyl phosphate or fluoroparraffins, and/or a low boiling solvent such as methyl acetate, ethyl acetate, propyl acetate, butyl acetate, butyl propionate, cyclohexanol, diethyleneglycol monoacetate, nitromethane, carbon tetrachloride, chloroform, cyclohexane, tetrahydrofuran, methyl alcohol, acetonitrile, dimethylformamide, dioxane, methyl ethyl ketone, etc., the resultant solution is mixed with an aqueous solution containing an anionic surfactant such as alkylbenzenesulfonic acid and alkylnaphthalenesulfonic acid and/or a nonionic surfactant such as sorbitane sesquioleic acid ester and sorbitane monolauryl acid ester and/or a hydrophilic binder such as gelatin, etc., emulsified by means of a high speed rotary mixer, a colloid mill or a ultrasonic dispersing device, etc., and added into the silver halide emulsion.

Otherwise, the above coupler may also be dispersed by use of the latex dispersing method. The latex dispersing method and its effect are described in Japanese Unexamined Patent Publications Nos. 74538/1974, 59943/1976, 32552/1979 and Research Disclosure, August, 1976, No. 14850, p. 77–79.

Suitable latices are homopolymers, copolymers or terpolymers of monomers such as styrene, acrylate, n-butyl acrylate, n-butylmetharylate, 2-acetoacetoxyethyl methacrylate, 2-(methacryloyloxy)ethyltrimethylammoniummethosulfate, sodium 3-(methacryloyloxy)propane-1-sulfonate, N-isopropylacrylamide, N-[2-(2-methyl-4-oxopentyl)]acrylamide, 2-acrylamide-2-methylpropanesulfonic acid, etc.

The above DIR compounds can be synthesized according to the methods as described in U.S. Pat. Nos. 3,227,554, 3,615,506, 3,617,291, 3,632,345, 3,928,041, 3,933,500, 3,938,996, 3,958,993, 3,961,959, 4,046,574, 4,052,213, 4,063,950, 4,095,984, 4,149,886, 4,234,678, U.K. Patent Nos. 2,072,363, 2,070,266, Research Disclosure 21228 (1981), Japanese Unexamined Patent Publications Nos. 81144/1975, 81145/1975, 13239/1976, 64927/1976, 104825/1976, 105819/1976, 65433/1977, 82423/1977, 117627/1977, 130327/1977, 154631/1977, 7232/1978, 9116/1978, 29717/1978, 70821/1978, 103472/1978, 110529/1978, 135333/1978, 143223/1978, 13333/1979, 49138/1979, 114241/1979, 35858/1982, 145135/1979, 161237/1980, 114946/1981, 154234/1982, 56837/1982, 160954/1983 and 162949/1983.

The development inhibitor released from the DIR compound according to the present invention during development corresponding to the density of the image inhibits development corresponding to the image density within the layer, when the layer is a light-sensitive emulsion layer, whereby the so called intra-image effect such as improvement in sharpness of the image, etc., can be obtained. On the other hand, when the development inhibitor released is diffused into another layer, there is obtained the so called inter-image effect such as the masking action which inhibits development in another layer corresponding to the image density in the layer from which it was diffused. Thus two kinds of image effects can be obtained.

The DIR compound according to the present invention can be added in light-sensitive silver halide emulsion layers and/or non-light-sensitive photographic constituent layers. Preferably, it may be added in at least one layer of silver halide emulsion layers. For example, when it is applied for a conventional multilayer color photographic material having a blue-sensitive silver halide emulsion, a green-sensitive silver halide emulsion and a red-sensitive silver halide emulsion, it may be contained in one layer or two or more layers of these emulsion layers.

The silver halide emulsion according to the present invention can be sensitized with a sensitizing dye conventionally used. The combinations of sensitizing dyes to be used for ultra-color sensitization of internal latent image type silver halide emulsion, nega type silver halide emulsions are also useful for the silver halide emulsion of the present invention. Concerning sensitizing dyes, reference can be made to Research Disclosure No. 15162.

The color photographic material of the present invention can be subjected to image exposure according to a conventional method, followed by surface development to give easily a direct posi image. That is, the principal steps for preparation of direct posi image comprises subjecting the internal latent image type color photographic material not previously fogged of the present invention to the treatment of forming a surface development nucleus by chemical action or photochemical action (hereinafter called fogging treatment) after image exposure, and then, namely after application of the fogging treatment and/or while applying the fogging treatment, carrying out the surface development. Here, the fogging treatment can be carried out by subjecting the whole surface to exposure or by use of a compound capable of forming a fog nucleus (hereinafter called fogging agent).

In the present invention, the whole surface exposure is carried out by dipping or wetting the photographic material subjected to image exposure in a developer or another aqueous solution, followed by uniform exposure over the whole surface. As the light source to be employed here, any light within the sensitive wavelength region of the color photographic material may be available, and it is possible to irradiate a high luminance light such as a flush light for a short time or alternatively irradiate a weak light for a long time.

The time for the whole surface exposure can be varied over a wide range depending on the photographic material, the developing conditions, the light source employed, etc., so that the best posi image can be finally obtained.

In the present invention, as the fogging agent to be used, various kinds of compounds can be used, and the fogging agent may be present during the developing processing. For example, it can be contained in a constituent layer of the photographic material other than the support (among them, silver halide emulsion layer is particularly preferred), or in a developing solution or in processing solutions prior to developing processing. Its amount can be varied over a wide range depending on the purpose, and it is preferable to use 1 to 1500 mg, more preferably 10 to 1000 mg of the fogging agent per mol of the silver halide when it is added in the silver halide emulsion layer. On the other hand, when added in processing solutions such as developing solutions, preferable amount added may be 0.01 to 5 g/liter, particularly preferably 0.05 to 1 g/liter.

Examples of the fogging agent to be used in the present invention include hydrazines disclosed in U.S. Pat. Nos. 2,563,785, 2,588,982, or hydrazide or hydrazone compounds disclosed in U.S. Pat. No. 3,227,552; heterocyclic quaternary nitrogen salt compounds disclosed in U.S. Pat. Nos. 3,615,615, 3,718,470, 3,719,494, 3,734,738 and 3,759,901; and further compounds having adsorptive groups onto the silver halide surface such as acylhydrazinophenylthio ureas disclosed in U.S. Pat. No. 4,030,925. Also, these fogging agents may be used in combination. For example, Research Disclosure No. 15162 describes about using a non-adsorptive type fogging agent and an adsorptive type fogging agent in combination.

As the fogging agent to be used in the present invention, either nonadsorptive type or adsorptive type can be used and it is also possible to use both of them in combination.

Typical examples of useful fogging agents include hydrazine compounds such as hydrazine hydrochloride phenylhydrazine hydrochloride, 4-methylphenylhydrazine hydrochloride, 1-formyl-2-(4-methylphenyl)hydrazine, 1-acetyl-2-phenylhydrazine, 1-acetyl-2-(4-acetamidophenyl)hydrazine, 1-methylsulfonyl-2-phenylhydrazine, 1-benzoyl-2-phenylhydrazine, 1-methylsulfonyl-2-(3-phenylsulfonamidophenyl)hydrazine, formaldehyde phenylhydrazine and the like; N-substituted quaternary cycloammonium salts such as 3-(2-formylethyl)-2-methylbenzothiazoliniumbromide, 3-(2-formylethyl)-2-propylbenzothiazoliniumbromide, 3-(2-acetylethyl)-2-benzylbenzoselenazoliumbromide, 3-(2-acetylethyl)-2-benzyl-5-phenylbenzoxazoliumbromide, 2-methyl-3-[3-(phenylhydrazino)-propyl]benzothiazoliumbromide, 2-methyl-3-[3-(p-tolylhydrazino)-propyl]benzothiazoliumbromide, 2-methyl-3-[3-(p-sulfophenylhydrazino)propyl]benzothiazoliumbromide, 2-methyl-3-[3-(p-sulfophenylhydrazino)pentyl]benzothiazolium iodide, 1,2-dihydro-3-methyl-4-phenylpyrido[2,1-b]benzothiazoliumbromide, 1,2-dihydro-3-methyl-4-phenylpyrido[2,1-b]-5-phenylbenzoxazoliumbromide, 4,4'-ethylenebis(1,2-dihydro-3-methylpyrido[2,1-b]benzothiazoliumbromide, 1,2-dihydro-3-methyl-4-phenylpyrido[2,1-b]benzoselenazoliumbromide and the like; 5-[1-ethylnaphtho(1,2-b)thiazolin-2-ylideneethylydene]-1-(2-phenycarbazoyl)methyl-3-(4-sulfamoylphenyl)-2-thiohydantoin, 5-(3-ethyl-2-benzothiazolinydene)-3-[4-(2-formylhydrazino)phenyl]rhodanine, 1-[4-(2-formylhydrazino)phenyl]-3-phenylthiourea, 1,3-bis[4-(2-formylhydrazino)phenyl]thiourea, and so on.

The photographic material having the silver halide emulsion layer according to the present invention forms a direct posi image by subjecting the whole surface to exposure or effecting developing processing in the presence of a fogging agent, after image exposure. As the method for developing processing of the photographic material according to the present invention, any desired developing processing method may be employed, but preferably the surface developing processing method is used. The surface developing processing method means processing with a developing solution containing substantially no silver halide solvent.

The color developing solution to be used in processing of the silver halide emulsion layer according to the present invention is an aqueous alkaline solution containing a color developing agent having a pH preferably of 8 or higher, more preferably of 9 to 12. The aromatic primary amine developing agent as the color developing agent is a compound having primary amino group on the aromatic ring with an ability to develop the exposed silver halide, and further a precursor capable of forming such a compound may be added.

Typical examples of the above color developing agent are p-phenylenediamine type compounds, and preferably examples include the following:

4-Amino-N,N-diethylaniline, 3-methyl-4-amino-N,N-diethylaniline, 4-amino-N-ethyl-N-β-hydroxyethylaniline, 3-methyl-4-amino-N-β-hydroxyethylaniline, 3-methyl-4-amino-N-ethyl-N-β-methoxyethylaniline, 3-methyl-4-amino-N-ethyl-N-β-methanesulfonamidoethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline, or salts thereof such as sulfates, hydrochlorides, sulfites, p-toluenesulfonates, etc.

Further, those disclosed in, for example, Japanese Unexamined Patent Publications Nos. 64932/1973, 131526/1975, 95849/1976 and Bent et al, Journal of the American Chemical Society, vol. 73, p. 3100–3125, 1951 may also be included as typical examples.

The amount of these aromatic primary amino compounds used may be determined depending on the activity of the developing solution set, and it is preferable to increase the amount used in order to increase the activity. The amount used may be within the range of from 0.0002 mol/liter to 0.7 mol/liter. Also, depending on the purpose, two or more compounds may be suitably selected and used. For example, any derised combination can freely be used depending on purposes, etc., such as the combinations of 3-methyl-4-amino-N,N-diethylaniline with 3-methyl-4-amino-N-ethyl-N-β-methanesulfonamidoethylaniline, 3-methyl-4-amino-N-ethyl-N-β-methanesulfonamidoethylaniline with 3-methyl-4-amino-N-ethyl-N-β-hydroxyethylaniline, etc.

The color developing solution to be used in the present invention can further incorporate various components conventionally added, for example, alkali agents such as sodium hydroxide, sodium carbonate, etc., alkali metal sulfites, alkali metal hydrogen sulfites, alkali metal thiocyanates, alkali metal halides, benzyl alcohol, water softeners, thickeners and development promoters, as desired.

Other additives than those as mentioned above which can be added to the above color developing solution may include, for example, bromides such as potassium bromide, ammonium bromide, alkali iodides, stain preventives, sludge preventives, preservatives, overlaying effect promoting agents, chelating agents, etc.

The developing solution to be used in the present invention can further contain specific antifoggants and development inhibitors, or alternatively those additives in the developing solution may also be incorporated in the constituent layers of the photographic material as desired. Usually, useful antifoggants may include benzotriazoles such as 5-methylbenzotriazole, benzimidazoles, benzothiazole, benzooxazoles, heterocyclic thiols such as 1-phenyl-5-mercaptotetrazole, aromatic and aliphatic mercapto compounds, etc. It is also possible to incorporate a development accellator such as a polyalkyleneoxide derivative or a quaternary ammonium salt compounds in the developing solution.

In the silver halide emulsion according to the present invention, various additives for photography can be added as desired.

Otherwise, in the present invention, the additives to be added depending on purposes may include wetting agents such as dihydroxyalkanes, etc.; further film property improving agents such as copolymers of alkyl acrylate or alkyl methacrylate with acrylic acid or methacrylic acid, styrene-maleic acid copolymers, styrene maleic anhydride half alkyl ester copolymers, etc., which are fine particulate polymeric materials dispersible in water obtained by emulsion polymerization; and also coating aids such as saponine, polyethyleneglycol lauryl ether, etc. It is also possible to use freely other additives for photography such as gelatin plasticizers, surfactants, UV-ray absorbers, pH controllers, antioxidants, antistatic agents, thickeners, graininess improvers, dyes, mordants, brighteners, development speed controllers, matting agents, etc.

The silver halide emulsion prepared as described above is coated on a support through intermediary subbing layer, halation preventive layer, filter layer, etc., if necessary, to give an internal latent image type photographic material.

It is useful to apply the photographic material according to the present invention for color photography and, in this case, dye image forming couplers of cyan, magenta and yellow should preferably be contained in the silver halide photographic emulsion. As the couplers, those conventionally used may be available.

It is also useful to use a UV-ray absorber such as thiazolidone, benzotriazole, acrylonitrile, benzophenone compounds in order to prevent brown coloration of the dye images with active rays of short wavelength. Particularly, it is advantageous to use singly or in combination Tinuvin PS, 320, 326, 327 and 328 (all produced by Ciba Geigy Co.).

As the support of the photographic material according to the present invention, any material may be used.

Typical examples of the support may include polyethyleneterephthalate film, polycarbonate film, polystyrene film, polypropylene film, cellulose acetate film, glass, baryta paper, polyethylene laminated paper, etc., which are optionally applied with subbing treatment.

In the silver halide emulsion layer according to the present invention, as a protective colloid or a binder, suitable gelatin derivatives other than gelatin can be used depending on the purpose. Examples of the suitable gelatin derivative include acylated gelatin, guanidylated gelatin, carbamylated gelatin, cyanoethanolated gelatin, esterified gelatin and the like.

Also, in the present invention, other hydrophilic binders can be contained depending on the purpose. Such binders may include colloidal albumin, agar, gum arabic, dextran, alginic acid, cellulose derivatives such as cellulose acetate hydrolyzed to acetyl content of 19 to 20%, polyacrylamide, imidated polyacrylamide, casein, vinyl alcohol polymer containing an urethane carboxylic acid group or a cyanoacetyl group such as vinyl alcoholvinyl aminoacetate copolymer, polyvinyl alcohol, polyvinylpyrrolidone, hydrolyzed polyvinyl acetate, polymers obtained by polymerization of a protein or a saturated acylated protein with a monomer having a vinyl group, polyvinylpyridine, polyvinylamine, polyaminoethyl methacrylate, polyethyleneamine, etc. They can be added depening on the purpose in the photographic light-sensitive material constituent layers such as emulsion layer or intermediate layer, protective layer, filter layer, backing layer, etc. Further, the above hydrophilic binder can incorporate suitable plasticizers, lubricants, etc., depending on the purpose.

Also, the constituent layers of the internal latent image light-sensitive material according to the present invention can be hardened with any suitable film hardening agent. Examples of these film hardening agents include chromium salts, zirconium salts, aldehyde type compounds, halotriazine type compounds or polyepoxy compounds such as formaldehyde or mucohalogenic acid, ethyleneimine type, vinylsulfone type, acryloyl type film hardening agents, etc.

Also, the photographic material according to the present invention can have a large number of various photographic constituent layers on a support such as emulsion layer, filter layer, intermediate layer, protective layer, subbing layer, backing layer, halation preventive layer, etc.

The photographic material according to the present invention can be effectively applied for various uses such as for black and white in general, for X-ray, for color, for false color, for printing, for infrared, for micro and for silver dye bleaching. It is also applicable for the colloid transfer method, the silver salt diffusion transfer method, and the color image transfer method, the color diffusion transfer method or the absorption transfer method as disclosed in U.S. Pat. Nos. 3,087,817, 3,185,567, and 2,983,606 of Rogers, U.S. Pat. No. 3,253,915 of Wayyarts, U.S. Pat. No. 3,227,550 of Whitemore, U.S. Pat. No. 3,227,551 of Barr, U.S. Pat. No. 3,227,552 of Whitemore and U.S. Pat. Nos. 3,415,644, 3,415,645 and 3,415,646 of Land.

(EXAMPLES)

The present invention is described in more detail by referring to the following examples.

EXAMPLE-1

A mono-dispersed core/shell emulsion was prepared as follows. While maintaining an aqueous solution containing gelatin at 50° C., equal moles of an aqueous silver nitrate solution and an aqueous potassium bromide solution were added thereto simultaneously according to the control double jet method to obtain a 0.40 μm cubic silver bromide emulsion. The resultant emulsion was chemically sensitized with addition of sodium thiosulfate and potassium chloroaurate. Using the emulsion thus obtained as the core, an aqueous silver nitrate solution and an aqueous potassium bromide solution were further added simultaneously to obtain a 0.55 μm cubic core/shell emulsion. The resultant core/shell emulsion was chemically sensitized with addition of sodium thiosulfate and potassium chloroaurate to obtain an emulsion, which is called Emulsion-A.

A mono-dispersed core/shell Emulsion-B was prepared similarly as Emulsion-A. However, the core of Emulsion-B was 0.22 μm cubic silver emulsion, which became 0.35 μm when coated with the shell.

To Emulsion-A and Emulsion-B were added each 90 mg/AgX mol of the sensitizing dye shown by the following Formula [S-1] to give green-sensitive emulsions.

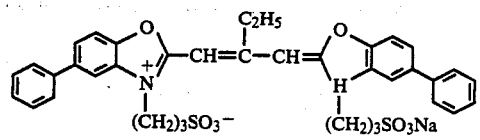

[S-1]

Green-sensitive Emulsion-A and Emulsion-B were mixed at a ratio of 1:1 and an oil-protect dispersion of a magenta coupler 1-(2,4,6-trichlorophenyl)-3-(2-chloro-5-octadecylsuccineimidoanilino)-5-pyrazolone was added to the mixture so that the above coupler became 0.25 mol per mol of silver halide, followed by addition of a film hardening agent, and the resultant composition was applied on a cellulose triacetate support so as to give a coated silver amount of 20 mg/100 cm$^2$, and dried. The sample obtained is called Sample-1(Control).

Another sample was prepared in the same manner as Sample-1, but in place of the above magenta coupler dispersion an oil-protective dispersion prepared with addition of a DIR exemplary compound (D-64) to the magenta coupler at a weight ratio of 5% based on the magenta coupler was used. The sample obtained is called Sample-2 (this invention).

These samples were subjected to wedge exposure through a yellow filter by means of a sensitometer, and developed with a developing solution shown below at 30° C. for 2, 3 and 4 minutes to prepare developped samples.

| | |
|---|---|
| 4-Amino-3-methyl-N—ethyl-N—(β-methanesulfoneamidoethyl)aniline sulfate | 5 g |
| Sodium sulfite (anhydrous) | 2 g |
| Sodium carbonate (monohydrate) | 15 g |
| Potassium bromide | 1 g |
| Benzyl alcohol | 10 ml |
| Water (adjusted to pH 10.2 with potassium hydroxide) | Added to 1 liter |

However, 30 seconds after initiation of development, the whole surface was exposed uniformly to white light of 1 lux for 30 seconds. Then, following the conventional procedure, bleaching, fixing, water washing were conducted followed by drying.

For the magenta posi images obtained, the maximum density (Dmax), the minimum density (Dmin), shoulder gamma, foot gamma and gamma ratio were measured to obtain the results shown in Table 1. The shoulder gamma is represented by the absolute value of gamma connecting the density point of Dmin+(Dmax−Dmin)×0.5 and the density point of Dmin+(Dmax−Dmin)×0.8. The foot gamma is represented by the absolute value of gamma connecting the density point of Dmin+(Dmax−Dmin)×0.2 and the density point of Dmin+(Dmax+Dmin)×0.5. The gamma ratio is represented as the value of shoulder gamma/foot gamma.

TABLE 1

| Sample | Developing time | Dmax | Dmin | Shoulder gamma | Foot gamma | Gamma ratio |
|---|---|---|---|---|---|---|
| Sample 1 | 2′ | 1.27 | 0.10 | 0.46 | 0.62 | 0.74 |
| (Control) | 3′ | 1.93 | 0.15 | 1.08 | 0.78 | 1.39 |
| | 4′ | 2.15 | 0.17 | 1.42 | 0.86 | 1.65 |
| Sample 2 | 2′ | 1.22 | 0.09 | 0.64 | 0.69 | 0.93 |
| (Invention) | 3′ | 1.89 | 0.14 | 0.85 | 0.78 | 1.09 |
| | 4′ | 2.19 | 0.15 | 0.92 | 0.84 | 1.10 |

As can be seen from the results of Table-1, the Sample-2 containing the DIR compound of the present invention exhibits smooth gradation characteristic with a gamma ratio which is approximate to 1.0. Further, when the developing time has changed, the Sample-1 of Control is fluctuated greatly in gamma ratio. In contrast, the Sample-2 of the present invention containing the DIR compound is small in fluctuation of gamma ratio.

EXAMPLE-2

Sample-1 and Sample-2 obtained in Example-1 were subjected to wedge exposure in the same manner as Example-1, developed with a developing solution with a recipe shown below at 30° C. for 3 minutes, and then bleaching, fixing, water washing and drying were performed (Processing-1).

| | |
|---|---|
| 4-Amino-3-methyl-N—ethyl-N—(β-methanesulfoneamidoethyl)aniline sulfate | 4.5 g |
| Sodium sulfite (anhydrous) | 5 g |
| Sodium carbonate (monohydrate) | 40 g |
| Potassium bromide | 1 g |
| 5-Methylbenztriazole | 10 mg |
| Benzyl alcohol | 10 ml |
| 1-Acetyl-2-phenylhydrazine (fogging agent) | 0.2 g |
| Water | added to 1 liter |
| (adjusted to pH 12.0 with potassium hydroxide). | |

Processing-2 was conducted in the same manner as the above Processing-1, but in Processing-2, the amount of 1-acetyl-2-phenylhydrazine in the developing solution in Processing-1 was increased from 0.2 g to 0.5 g.

Processing-3 was conducted in the same manner as the above Processing-1, but in Processing-3 the amount of 5-methylbenztriazole a in the developer was increased from 10 mg to 50 mg.

For the posi images obtained in the above Processing-1 to Processing-3, maximum density, minimum density and gamma value were measured to obtain the results shown in Table-2. The gamma value represents the absolute value of gamma connecting the density point of Dmin+(Dmax−Dmin)×0.2 and the density point of Dmin+(Dmax−Dmin)×0.8.

TABLE 2

| | Processing 1 | | | Processing 2 | | | Processing 3 | | |
|---|---|---|---|---|---|---|---|---|---|
| Sample 1 | Dmax | Dmin | Gamma value | Dmax | Dmin | Gamma value | Dmax | Dmin | Gamma value |
| Sample 1 (Control) | 1.95 | 0.15 | 1.02 | 2.14 | 0.15 | 1.25 | 1.87 | 0.14 | 1.43 |
| Sample 2 (Invention) | 1.91 | 0.15 | 0.92 | 1.94 | 0.15 | 1.00 | 1.88 | 0.13 | 0.93 |

As can be understood from the results in Table 2, the Sample-2 of the present invention containing the DIR compound exhibits stable photographic performance even when the processing liquor composition may be fluctuated.

EXAMPLE-3

A mono-dispersed core/shell emulsion was prepared as follows. While maintaining an aqueous solution containing gelatin at 40° C., an aqueous ammonia solution containing silver nitrate and an aqueous solution containing potassium bromide were added simultaneously according to the control double jet method to obtain a 0.35 μm cubic silver halide emulsion. Subsequently, after water-soluble salts were removed by washing with water, the emulsion was schemically sensitized with addition of sodium thiosulfate and potassium chloroaurate. Using the emulsion thus obtained as the core, an aqueous silver nitrate solution and an aqueous solution containing potassium bromide were further added to obtain a 0.52 μm tetrahedral silver bromide emulsion. The surfaces of the grains obtained were chemically sensitized with addition of sodium thiosulfate and potassium choroaurate. This emulsion is called Emulsion-C.

Similarly to Emulsion-C, a 0.33 μm tetrahedral silver bromide core/shell emulsion (Emulsion-D) was obtained. However, in this case, with a 0.24 μm silver bromide emulsion chemically sensitized was used as the core, and a silver bromide shell was further coated thereon, followed further by chemical sensitization of the surface to prepare the emulsion.

To each of the Emulsion-C and a Emulsion-D prepared above, 90 mg of the sensitizing dye represented by Formula [S-2] shown below was added and the emulsions were mixed at a ratio of 1:1 to provide a red-sensitive emulsion.

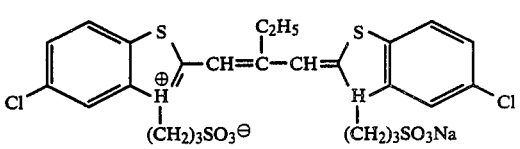

[S-2]

After the sensitizing dye represented by the above Formula [S-1] was added to each of Emulsion-C and Emulsion-D prepared above, the emulsions were mixed at a ratio of 1:1 to provide a green-sensitive emulsion.

Emulsion-C and Emulsion-D prepared above were mixed as such at a ratio of 1:1 to provide a blue-sensitive emulsion.

On a paper substrate laminated on both surfaces with polyethylene, the respective layers shown below were successively coated.

(1) Red-sensitive emulsion layer

This layer contains the above red-sensitive emulsion and 0.45 mol/AgX mol of an oil-protect dispersed cyan coupler 2,4-dichloro-3-methyl-6-[α-(2,4-di-t-amylphenoxy)butylamido]phenol.

(2) Intermediate layer

This layer contains an oil-protect dispersed 2,5-di-t-octylhydroquinone.

(3) Green-sensitive emulsion layer

This layer contains the above green-sensitive emulsion and 0.25 mol/AgX mol of an oil-protect dispersed magenta coupler 1-(2,4,6-trichlorophenyl)-3-(2-chloro- 5-octadecylsuccineimidoanilino)-5-pyrazolone and a magenta coupler simultaneously with an oil-protect dispersed DIR exemplary compound (D-6). Here, the DIR compound was used in an amount of 5 wt.% based on the coupler.

(4) Yellow filter layer

This layer contains yellow colloid silver and an oil-protect dispersed 2,5-di-t-octylhydroquinone.

(5) Blue-sensitive emulsion layer

This layer contains the above blue-sensitive emulsion and 0.45 mol/AgX mol of α-[4-(1-benzyl-2-phenyl-3,5-dioxo-1,2,4-triazolidynyl)]-α-pivaryl-2-chloro-5-[α-(2,4-di-t-amylphenoxy)butylamido]acetoanilide.

(6) Protective film

Gelatin layer.

The sample obtained is called Sample-3 (this invention).

Next, Sample-4 (Control) was prepared in the same manner as the above Sample-3 only except for adding no DIR compound in the green-sensitive emulsion layer.

The Sample-3 and the Sample-4 obtained were exposed through a wedge and a chart for measurement of image sharpness, and then the same processing as Example-1 was conducted. However, in case of the developing time was changed to 3 minutes. The whole surface exposure was carried out under the conditions of (1) 0.5 lux, 20 sec, (2) 2.0 lux, 20 sec, (3) 8.0 lux, 20 sec. However, in case of the samples for measurement of image sharpness the whole surface exposure was carried out only under the condition of 2.0 lux and 20 sec.

The gamma values of the respective samples obtained are shown in Table-3. Also, MTF (Modulation Transfer Function) was determined by a microdensitometer and the MTF values at space frequency of 5 lines/mm were compared. The results are also shown together in Table-3.

TABLE 3

| Sample | Whole surface exposure luminosity (lux) | Gamma value | | | MTF value | | |
|---|---|---|---|---|---|---|---|
| | | Yellow | Magenta | Cyan | Yellow | Magenta | Cyan |
| Sample-3 (invention) | 0.5 | 0.89 | 1.08 | 1.20 | 65 | 69 | 44 |
| | 2.0 | 0.97 | 1.14 | 1.22 | | | |
| | 8.0 | 1.05 | 1.20 | 1.27 | | | |
| Sample-4 (Control) | 0.5 | 0.94 | 1.15 | 1.27 | 55 | 53 | 40 |
| | 2.0 | 1.23 | 1.22 | 1.44 | | | |
| | 8.0 | 1.34 | 1.51 | 1.84 | | | |

As can be seen from the results in Table 3, when the condition for whole surface exposure was varied, the Sample-3 of the present invention is small in fluctuation of gamma value to give a photograph of more stable quality. Further, it can be appreciated that the Sample-3 of the present invention has very high image sharpness.

EXAMPLE-4

When the same experiment as Example-3 was conducted for samples in which the DIR exemplary compound (D-6) in Sample-3 in Example-3 was changed to (D-11), (D-24), (D-66) and (D-72), good results equal to Example-3 could be obtained in any case.

By constituting the internal latent image type direct posi color photographic material as in the present invention, a photographic material of said type, which is good in processing stability, has smooth gradation and also good in sharpness, can be produced with good reproducibility.

What is claimed is:

1. In a light-sensitive direct posi silver halide color photographic material having photographic constituent layers comprising at least one silver halide emulsion layer containing latent image type silver halide grains not previously fogged, which is capable of giving a direct posi image by subjecting the whole surface to exposure or effecting surface development in the presence of a fogging agent, after image exposure, the improvement wherein said internal latent image type silver halide grains are composed of at least two groups of internal latent image type silver halide grains having average grain sizes different from each other, and at least one compound capable of releasing a development inhibiting substance or its precursor through the reaction with the oxidized product of a color developing agent is contained in at least one layer of said photographic constituent layers.

2. The material according to claim 1, wherein said internal latent image type silver halide grains are composed of two groups of internal latent image type silver halide grains having average grain sizes different from each other.

3. The material according to claim 2, wherein the average grain size of one group of said two groups of internal latent image type silver halide grains is 90% or less based on the average grain size of the other group of said two groups of internal latent image type silver halide grains.

4. The material according to claim 2, wherein the mixing ratio of said two groups of internal latent image type silver halide grains having average grain sizes different from each other is from 5:95 to 95:5.

5. The material according to claim 4, wherein the mixing ratio is from 10:90 to 90:10.

6. The material according to claim , wherein said at least two groups of internal latent image type silver halide grains having average grain size different from each other are mono-dispersed ones in which 60 wt. % or more of individual silver halide grains have sizes which are not different from the respective average grain sizes by 20% or more.

7. The material according to claim 1, wherein the respective average grain sizes of said at least two groups of internal latent image type silver halide grains having average grain size different from each other are from 0.2 to 1.4 μm.

8. The material according to claim 7, wherein said respective average grain sizes are from 0.3 to 1.2 μm.

9. The material according to claim 1, wherein said at least one compound capable of releasing a development inhibiting substance is one represented by Formula (I):

Coup-inhibitor (I)

wherein "Coup" is a coupler component which can undergo coupling with the oxidized product of a color developing agent and is selected from the group consisting of open-chain ketomethylene compounds, dye forming couplers and coupling components which do not form dyes; and "inhibitor" is a component which is eliminated by the reaction with a color developing agent and inhibits development of silver halide and is selected from the group consisting of heterocyclic compounds and heterocyclic mercapto compounds.

10. The material according to claim 9, wherein the open-chain ketomethylene compounds represented by "Coup" are an acylacetoanilide and an acylacetic acid ester; the dye forming couplers represented by "Coup" are a pyrazolone, a pyrazolotriazole, a pyrazolinobenzimidazole, an indazolone, a phenol and a naphthol; and the coupling components which do not form dyes represented by "Coup" are an acetophenone, an indanone and an oxazolone;

the heterocyclic compounds and the heterocyclic mercapto compounds represented by "inhibitor" are ones in which a heterocyclic group is 1-phenyltetrazolyl, 1-ethyltetrazolyl, 1-(4-hydroxyphenyl)-tetrazolyl, 1,3,4-thiazolyl, 5-methyl-1,3,4-oxadiazolyl, benzthiazolyl, benzoxazolyl, benzimidazolyl or 4H-1,2,4-triazolyl group.

11. The material according to claim 1, wherein said at least one compound capable of releasing a development inhibiting substance is one represented by Formula (II):

Coup-Time-inhibitor (II)

wherein "Coup" is a coupler which can undergo coupling with the oxidized product of a color developing agent and is selected from the group consisting of open-chain ketomethylene compounds, dye forming couplers and coupling components which do not form dyes; "inhibitor" is a component which is eliminated by the reaction with a color developing agent and inhibits development of silver halide and is selected from the group consisting of heterocyclic compounds and heterocyclic mercapto compounds; and "Time" is a group selected from the group consisting of groups represented by Formulae (II), (IV), (V) and (VI):

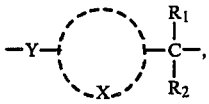
Formula (III)

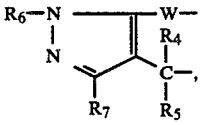
Formula (IV)

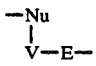
Formula (V)

and $-OCH_2-$. Formula (VI)

12. The material according to claim 11, wherein the open-chain ketomethylene compounds represented by "Coup" are an acylacetonanilide and an acylacetic acid ester, the dye forming couples represented by "Coup" are a pyrazolone, a pyrazolotriazole, a pyrazolinbenzimidazole, an indazolone, a phenol and a naphthol, and the coupling components which do not form dyes represented by "Coup" are an acetophenone, an indanone and an oxazolone;

the heterocyclic compounds and the heterocyclic mercapto compounds represented by "inhibitor" are ones in which a heterocyclic group is 1-phenyltetrazolyl, 1-ethyltetrazolyl, 1-(4-hydroxyphenyl)-tetrazolyl, 1,3,4-thiazolyl, 5-methyl-1,3,4-oxadiazolyl, benzthiazolyl, benzoxazolyl, benzimidazolyl or 4H-1,2,4-triazolyl group;

in "Time" represented by Formula (III), represents a group of atoms necessary for completion of a benzene ring or a naphthalene ring, Y represents —O—, —S—,

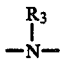

(wherein $R_3$ represents a hydrogen atom, an alkyl or aryl group), and is bonded to the coupling site, each of $R_1$ and $R_2$ represents the same group as the above $R_3$ and the group

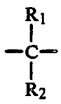

is substituted at the ortho-position or para-position relative to Y and is bonded to the heter atom contained in the inhibitor; in "Time" represented by Formula (IV), W is the same group as Y in the above Formula (III), and $R_4$ and $R_5$ are the same groups as $R_1$ and $R_2$ in Formula (III), respectively and $R_6$ is a hydrogen atom, an alkyl group, an aryl group, an acyl group, a sulfone group, an alkoxycarbonyl group or a heterocyclic residue, and $R_7$ represents a hydrogen atom, an alkyl group, an aryl group, a heterocyclic residue, an alkoxy group, an amino group, an acylamide group, a sulfoneamide group, a carboxy group, an alkoxycarbonyl group, a carbamoyl group or a cyano group and the timing group is bonded through W to the coupling site of Coup and is bonded through

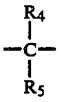

to the hetero atom of the inhibitor; and in "Time" represented by Formula (V), Nu is a nucleophilic group having oxygen, sulfur or nitrogen atom enriched in electrons and is bonded to the coupling position of Coup, E is an electrophilic group having a carbonyl group, a thiocarbonyl group, a phosfinyl group or a thiophosfinyl group deficient in electrons and is bonded to the hetero atom of the inhibitor, V is a bonding group which correlates sterically Nu and E with each other and is subject to intramolecular nucleophilic substitution reaction accompanied with formation of a 3-membered ring or 7-membered ring after release of Nu from Coup, and thereby can release the inhibitor.

13. The material according to claim 1, wherein a DIR compound is selected from the group consisting of (D-1)
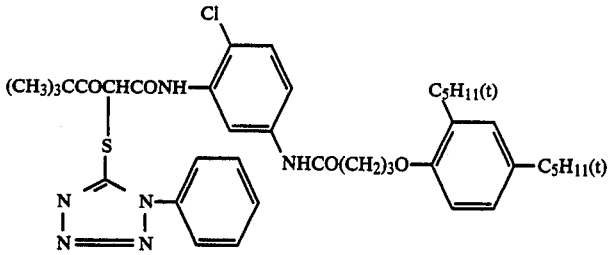
(D-6)
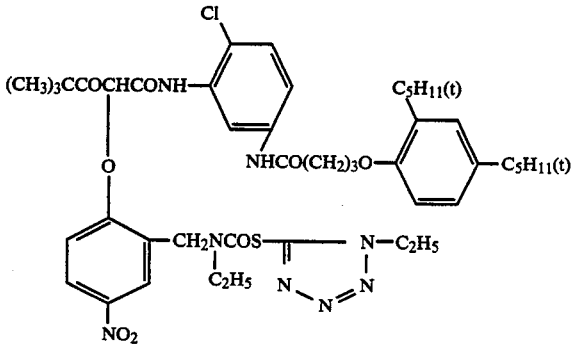
(D-10)
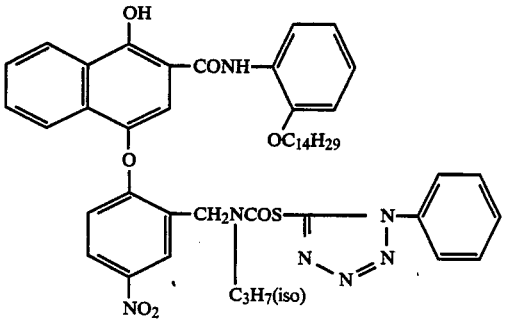
(D-16)
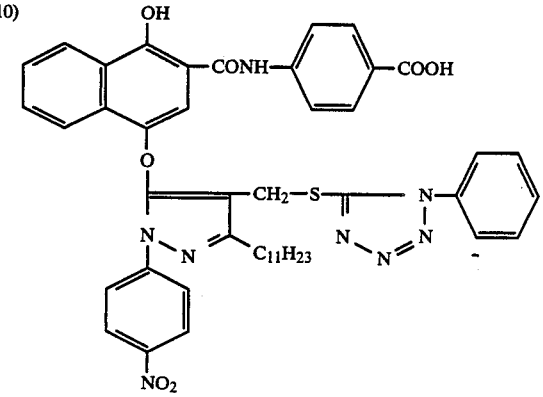
(D-23)
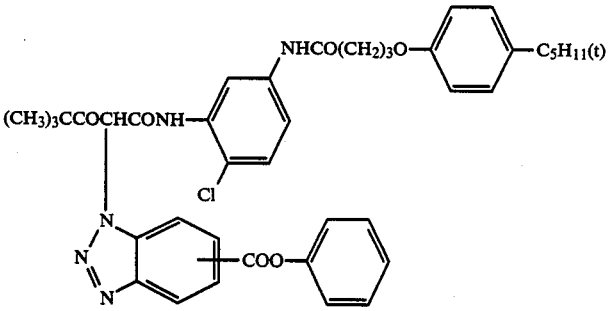
(D-24)
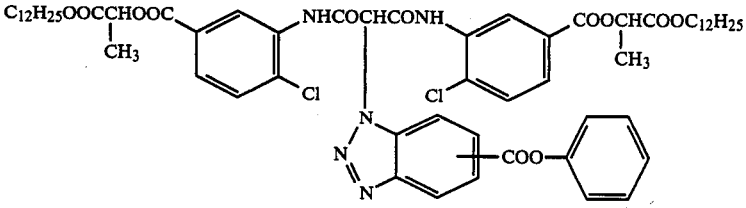

-continued
(D-29)
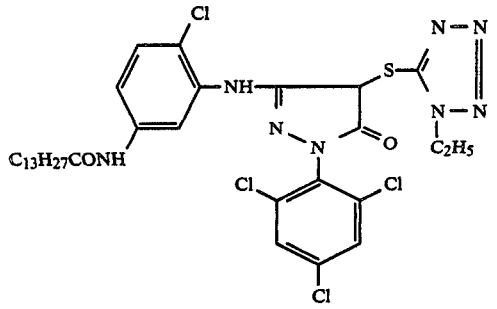
(D-58)
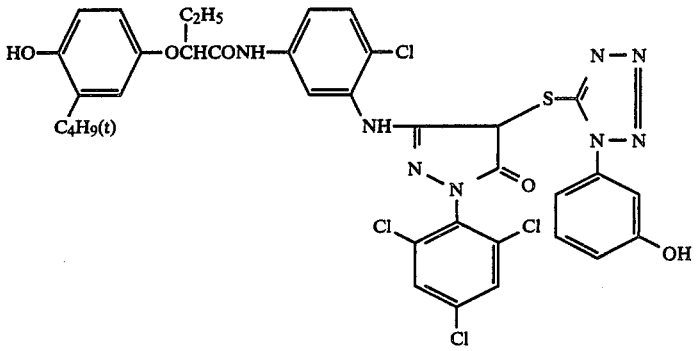
(D-62)
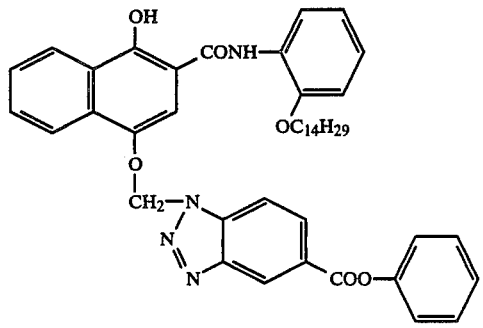
(D-63)
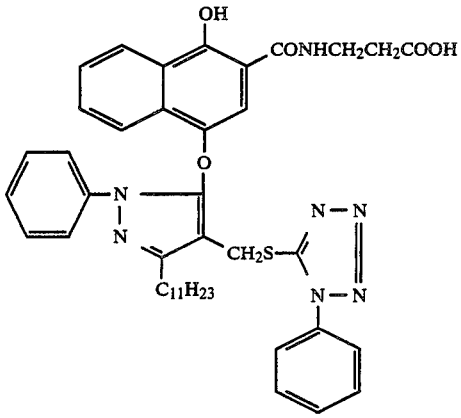
(D-64)
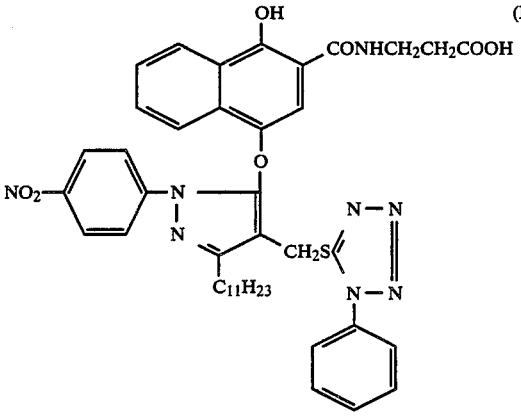
(D-66)
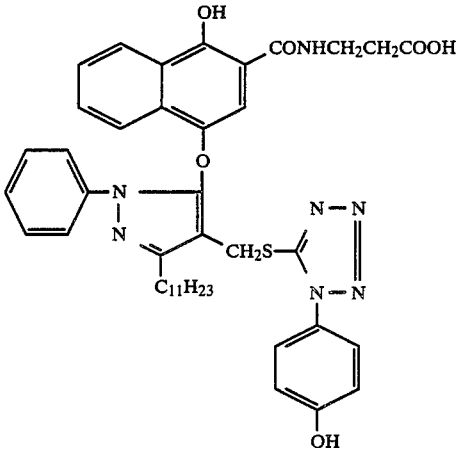

-continued
(D-69)
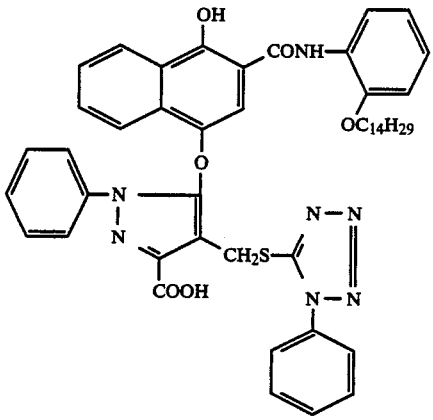
(D-72)
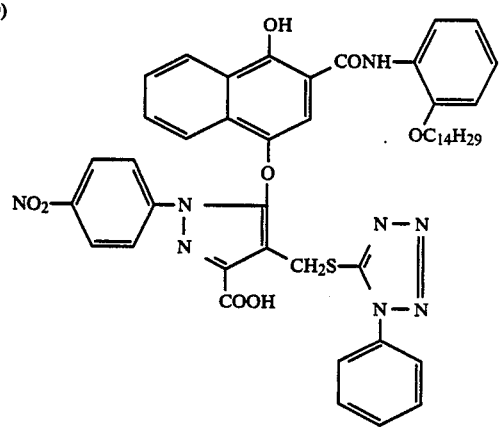
and
(D-73)
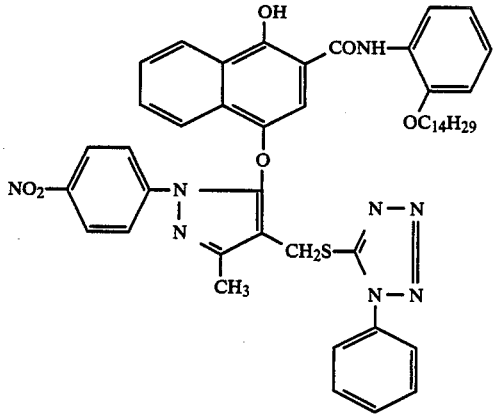
14. The material according to claim 1, wherein the DIR compound is contained in an amount of $2\times10^{-4}$ to $5\times10^{-1}$ mole per 1 mol of silver in the emulsion layer.
15. The material according to claim 14, wherein the DIR compound is contained in an amount of $1\times10^{-3}$ to $1\times10^{-1}$ mole per 1 mol of silver in the emulsion layer.
* * * * *